US011760087B2

(12) United States Patent
Yokoo

(10) Patent No.: US 11,760,087 B2
(45) Date of Patent: Sep. 19, 2023

(54) LIQUID DISCHARGING APPARATUS AND HEAD UNIT

(71) Applicant: Seiko Epson Corporation, Tokyo (JP)

(72) Inventor: Shoichiro Yokoo, Matsumoto (JP)

(73) Assignee: SEIKO EPSON CORPORATION

( * ) Notice: Subject to any disclaimer, the term of this patent is extended or adjusted under 35 U.S.C. 154(b) by 100 days.

(21) Appl. No.: 17/386,069

(22) Filed: Jul. 27, 2021

(65) Prior Publication Data

US 2022/0032613 A1 Feb. 3, 2022

(30) Foreign Application Priority Data

Jul. 28, 2020 (JP) ..... 2020-127093

(51) Int. Cl.
*B41J 29/377* (2006.01)
*B41J 2/045* (2006.01)
*B41J 2/17* (2006.01)

(52) U.S. Cl.
CPC ..... *B41J 2/04563* (2013.01); *B41J 2/04541* (2013.01); *B41J 2/04581* (2013.01); *B41J 2/1707* (2013.01); *B41J 29/377* (2013.01); *B41J 2202/08* (2013.01)

(58) Field of Classification Search
CPC ..... B41J 29/377
See application file for complete search history.

(56) References Cited

U.S. PATENT DOCUMENTS

2012/0069097 A1* 3/2012 Uezawa ..... B41J 2/18 347/65
2015/0224764 A1* 8/2015 Iijima ..... H05K 7/20436 347/17
2018/0178510 A1* 6/2018 Nakajima ..... B41J 2/17556
2019/0291487 A1* 9/2019 Tanaka ..... B41J 2/14233

FOREIGN PATENT DOCUMENTS

JP 2010-105377 A 5/2010
JP 2019-195911 A 11/2019

* cited by examiner

*Primary Examiner* — Shelby L Fidler
(74) *Attorney, Agent, or Firm* — Harness, Dickey & Pierce, P.L.C.

(57) ABSTRACT

A liquid discharging apparatus has: a head unit that discharges a liquid; and a control unit that controls the operation of the head unit. The head unit has: a driving circuit board that includes a driving signal output circuit that outputs a driving signal, and also includes a substrate on which the driving signal output circuit is mounted; a discharge head that includes a driving element driven by the driving signal, a switching circuit that selectively supplies the driving signal to the driving element, and a nozzle plate in which a nozzle is formed, the nozzle discharging the liquid by being driven by the driving element; a first flow path member through which the liquid to be discharged from the nozzle passes; and a first heat dissipating member coupled to the driving circuit board. The first heat dissipating member is coupled to the first flow path member.

8 Claims, 18 Drawing Sheets

| [SIH, SIL] | | [1, 1] (LD) | [1, 0] (MD) | [0, 1] (SD) | [0, 0] (ND) |
|---|---|---|---|---|---|
| S1 | T1 | H | H | H | L |
| | T2 | H | L | L | L |
| S2 | T1 | L | L | L | H |
| | T2 | L | H | L | L |

LIQUID DISCHARGING APPARATUS AND HEAD UNIT

The present application is based on, and claims priority from JP Application Serial Number 2020-127093, filed Jul. 28, 2020, the disclosure of which is hereby incorporated by reference herein in its entirety.

BACKGROUND

1. Technical Field

The present disclosure relates to a liquid discharging apparatus and a head unit.

2. Related Art

An ink jet printer makes a record by discharging a liquid to a medium so that the liquid lands on the medium. This type of ink jet printer uses a piezoelectric element, for example, as a driving element to discharge a liquid to a medium by driving the driving element. The piezoelectric element used as this type of driving element is a capacitive load such as a capacitor from an electrical viewpoint. To operate the piezoelectric element in correspondence with each nozzle, a sufficient current needs to be supplied. To drive the piezoelectric element, therefore, a sufficient current needs to be supplied. In view of this, a liquid discharging apparatus such as an ink jet printer has a driving signal output circuit, including an amplifier circuit and the like, that outputs a driving signal by which the piezoelectric element is driven.

Since the driving signal includes a large current used to drive the piezoelectric element, a large amount of heat is generated in the driving signal output circuit and various types of electronic parts provided on a path through which the driving signal propagates. As a result, the properties of the driving signal output circuit and electronic parts may change and the property of the driving signal may thereby deteriorate.

To deal with heat generated due to the use of this type of driving signal, JP-A-2010-105377 discloses an ink discharging apparatus structured so that a driving circuit that outputs a driving signal is cooled by an air flow.

However, the ink discharging apparatus (a type of liquid discharging apparatus) described in JP-A-2010-105377 merely cools the driving circuit by an air flow and exhausts heat. To enhance the energy efficiency of the liquid discharging apparatus, therefore, there has been a need for the liquid discharging apparatus to be susceptible to improvement.

SUMMARY

A liquid discharging apparatus according to one aspect of the present disclosure has: a head unit that discharges a liquid; and a control unit that controls the operation of the head unit. The head unit has: a driving circuit board that includes a driving signal output circuit that outputs a driving signal, and also includes a substrate on which the driving signal output circuit is mounted; a discharge head that includes a driving element driven by the driving signal, a switching circuit that selectively supplies the driving signal to the driving element, and a nozzle plate in which a nozzle is formed, the nozzle discharging the liquid by being driven by the driving element; a first flow path member through which the liquid to be discharged from the nozzle passes; and a first heat dissipating member coupled to the driving circuit board. The first heat dissipating member is coupled to the first flow path member.

A head unit according to one aspect of the present disclosure has: a driving circuit board that includes a driving signal output circuit that outputs a driving signal, and also includes a substrate on which the driving signal output circuit is mounted; a discharge head that includes a driving element driven by the driving signal, a switching circuit that selectively supplies the driving signal to the driving element, and a nozzle plate in which a nozzle is formed, the nozzle discharging a liquid by being driven by the driving element; a first flow path member through which the liquid to be discharged from the nozzle passes; and a first heat dissipating member coupled to the driving circuit board. The first heat dissipating member is coupled to the first flow path member.

DESCRIPTION OF EXEMPLARY EMBODIMENTS

Preferred embodiments of the present disclosure will be described below with reference to the drawings. These drawings are for convenience of explanation. The embodiments described below do not unreasonably restrict the contents of the present disclosure, the contents being described in the scope of claims. All of the structures described below are not always essential structural requirements.

1. First Embodiment

1.1 Functional Structure of a Liquid Discharging Apparatus

Figure 1A:
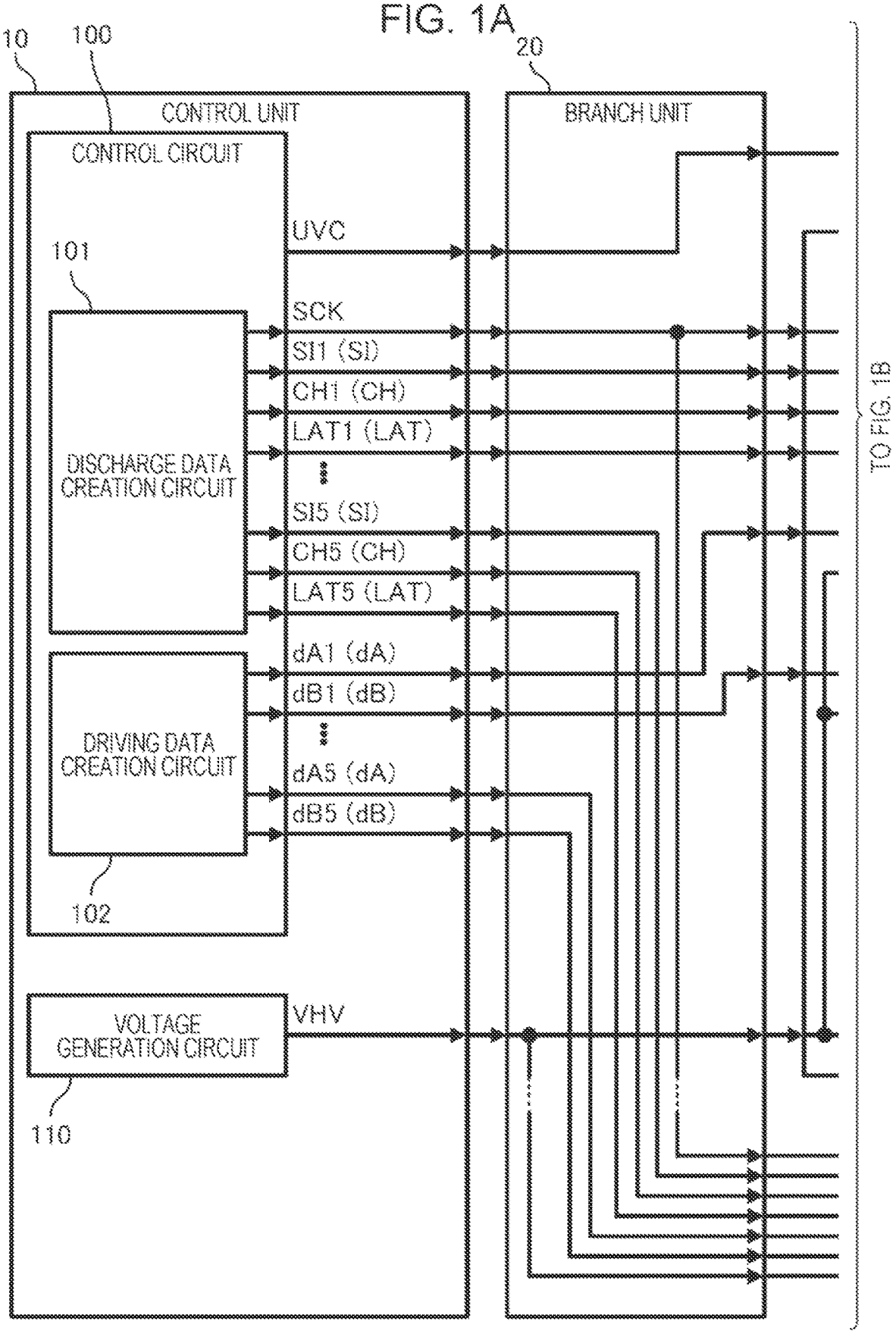
FIGS. 1A and 1B are a block diagram illustrating the functional structure of a liquid discharging apparatus in a first embodiment.
Figure 1B:
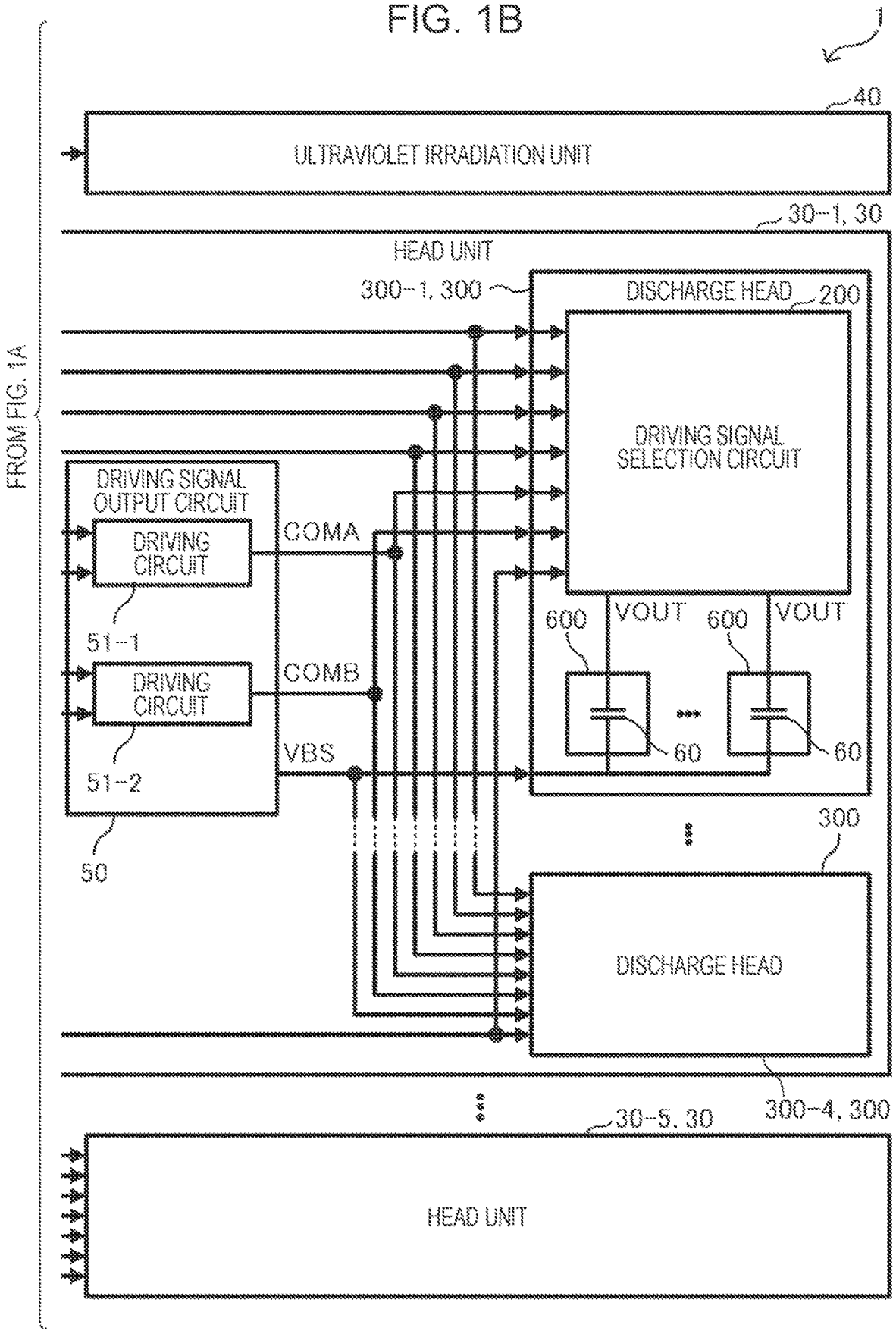

First, the functional structure of a liquid discharging apparatus 1 in a first embodiment will be described with reference to FIGS. 1A and 1B. FIGS. 1A and 1B are a block diagram illustrating the functional structure of the liquid discharging apparatus 1 in the first embodiment. In the description below, as an example of the liquid discharging apparatus 1, an ink jet printer will be taken that forms a desired image on a medium by discharging an ultraviolet (UV) curable ink, which is cured in a short time by being exposed to UV light or the like, as an example of a liquid. With this type of ink jet printer that uses a UV curable ink, ink is fixed to a medium through a chemical reaction, making it possible to form, on the medium, an image that is highly resistant to solvents and wear and is hard to peel off. UV curable ink will be referred to below as simply ink.

The liquid discharging apparatus 1 has a control unit 10, a branch unit 20, head units 30-1 to 30-5, and an ultraviolet irradiation unit 40 as illustrated in FIGS. 1A and 1B. In the liquid discharging apparatus 1 in the first embodiment, each of the head units 30-1 to 30-5 discharges ink to a medium as a liquid and the ultraviolet irradiation unit 40 and fixes the discharged ink to the medium. The control unit 10 controls the operation of the liquid discharging apparatus 1 by controlling the operations of the head units 30-1 to 30-5 and ultraviolet irradiation unit 40. The branch unit 20 branches various control signals output from the control unit 10 to control the operations of the head unit 30-1 to 30-5 and ultraviolet irradiation unit 40, and outputs the branch signals to the head units 30-1 to 30-5 and ultraviolet irradiation unit 40 accordingly. The control unit 10 may output various signals that control the operations of various other sections in the liquid discharging apparatus 1 such as, for example, a transport unit (not illustrated) that transports a medium and a carriage (not illustrated), on which the head units 30-1 to 30-5 are mounted, that moves along the main scanning direction, besides the head units 30-1 to 30-5 and ultraviolet irradiation unit 40.

The control unit 10 has a control circuit 100 and a voltage generation circuit 110. The voltage generation circuit 110 generates, for example, a direct-current voltage of 42 V used in the liquid discharging apparatus 1 from a commercially available power source voltage, which is an alternating-current voltage received from the outside of the liquid discharging apparatus 1, and outputs the direct-current voltage to the branch unit 20 as a voltage VHV. The voltage generation circuit 110 may generate direct-current voltages of various other volts such as, for example, 3.3 V, 5V, and 7.5V besides the voltage VHV, which is a direct-current voltage of 42 V. The voltage generation circuit 110 may also output the voltage VHV to various other sections in the liquid discharging apparatus 1 besides the branch unit 20.

The control circuit 100 creates various signals used to operate the head units 30-1 to 30-5 and ultraviolet irradiation unit 40 from image information received from an external device (not illustrated) such as a host computer, and outputs the created signals to the head units 30-1 to 30-5 and ultraviolet irradiation unit 40 accordingly.

The control circuit 100 has a discharge data creation circuit 101 and a driving data creation circuit 102. The discharge data creation circuit 101 creates a clock signal SCK, print data signals SI, change signals CH, and latch signals LAT, which are used to operate the head units 30-1 to 30-5, and outputs the created signals to the branch unit 20.

The clock signal SCK stipulates times to propagate the print data signal SI, change signal CH, and latch signal LAT. The print data signal SI stipulates selection of the waveforms of driving signals COMA and COMB described later. The print data signal SI also stipulates the size of a dot to be formed on a medium when ink lands on the medium. The change signal CH controls a time to switch the waveforms of the driving signals COMA and COMB. The latch signal LAT stipulates the cycle of a dot formed on the medium.

The discharge data creation circuit 101 creates the clock signal SCK in common to the head units 30-1 to 30-5, and also creates the print data signal SI, change signal CH, and latch signal LAT individually for each of the head units 30-1 to 30-5, after which the discharge data creation circuit 101 outputs the created signals to the branch unit 20. In the description below, when print data signals SI, which are supplied individually to the head units 30-1 to 30-5, need to be distinguished, the print data signals SI will be referred to as print data signals SI1 to SI5 in correspondence with the head units 30-1 to 30-5. Similarly, change signals CH and latch signals LAT supplied individually to the head units 30-1 to 30-5 will be respectively referred to as change signals CH1 to CH5 and latch signals LAT1 to LAT5 in correspondence with the head units 30-1 to 30-5, as necessary.

The discharge data creation circuit 101 may create the clock signal SCK, change signal CH, and latch signal LAT in common to the head units 30-1 to 30-5, and may also create the print data signal SI individually for each of the head units 30-1 to 30-5, after which the discharge data creation circuit 101 may output the created signals to the branch unit 20.

The driving data creation circuit 102 creates base driving signals dA and base driving signals dB used to operate the head units 30-1 to 30-5 and outputs the created signals to the branch unit 20.

The base driving signal dA is a digital signal that stipulates the shape of the waveform of the driving signal COMA created in a driving signal output circuit 50, which will be described later. The base driving signal dB is a digital signal that stipulates the shape of the waveform of the driving signal COMB. The driving data creation circuit 102 creates base driving signals dA and dB individually for each of the head units 30-1 to 30-5, and outputs these signals to the branch unit 20. In the description below, when base driving signals dA, which are supplied individually to the head units 30-1 to 30-5, need to be distinguished, the base driving signals dA will be referred to as base driving signals dA1 to dA5 in correspondence with the head units 30-1 to 30-5. Similarly, base driving signals dB supplied individually to the head units 30-1 to 30-5 will be referred to as base driving signals dB1 to dB5 in correspondence with head units 30-1 to 30-5, as necessary.

The control circuit 100 also creates an irradiation control signal UVC used to control the operation of the ultraviolet irradiation unit 40 and outputs the created signal to the branch unit 20.

The branch unit 20 includes branch lines through which the clock signal SCK and voltage VHV received from the control unit 10 branch in correspondence with the head units 30-1 to 30-5, and also includes propagation lines through which the print data signals SI1 to SI5, change signals CH1 to CH5, latch signals LAT1 to LAT5, base driving signals dA1 to dA5, and base driving signals dB1 to dB5 propagate to the corresponding head units 30-1 to 30-5. That is, the branch unit 20 receives signals used to control the operations of the head units 30-1 to 30-5 and ultraviolet irradiation unit 40 from the control unit 10, causes these signals to branch or propagate, and outputs the signals to the head units 30-1 to 30-5 and ultraviolet irradiation unit 40.

Specifically, the branch unit 20 receives the clock signal SCK, voltage VHV, print data signal SIi (where i is from 1 to 5), change signal CHi, latch signal LATi, base driving signal dAi, and base driving signal dBi from the control unit 10. Then, the branch unit 20 braches the clock signal SCK and voltage VHV, and outputs them to the head unit 30-*i*. Alternatively, the branch unit 20 propagates the print data signal SIi, change signal CHi, latch signal LATi, base driving signal dAi, and base driving signal dBi to the head unit 30-*i* without alteration.

The head unit 30-1 includes the driving signal output circuit 50 and discharge heads 300-1 to 300-4. The driving signal output circuit 50 includes driving circuits 51-1 and 51-2.

The driving circuit 51-1 receives the base driving signal dA1, which is a digital signal, and the voltage VHV. Then, the driving circuit 51-1 converts the received base driving signal dA1 to an analog signal, performs class-D amplification on the converted analog signal according to the voltage VHV to create the driving signal COMA, and outputs the created signal to the discharge heads 300-1 to 300-4. The driving circuit 51-2 receives the base driving signals dB1, which is a digital signal, and the voltage VHV. Then, the driving circuit 51-2 converts the received base driving signals dB1 to an analog signal, performs class-D amplification on the converted analog signal according to the voltage VHV to create the driving signal COMB, and outputs the created signal to the discharge heads 300-1 to 300-4.

The driving signal output circuit 50 creates a reference voltage signal VBS, which is a reference potential when ink is discharged from the discharge heads 300-1 to 300-4, according to the VHV or a direct-current voltage of, for example, 3.3 V generated according to the voltage VHV, and outputs the reference voltage signal VBS to the discharge heads 300-1 to 300-4.

As described above, the driving signal output circuit 50 includes two D-class amplification circuits that create the driving signals COMA and COMB as well as a step-down circuit or step-up circuit (not illustrated) that creates the reference voltage signal VBS. The driving circuits 51-1 and 51-2 only need to be capable of amplifying analog signals converted from the received base driving signals dA1 and dB1 according to the voltage VHV. Therefore, the driving circuits 51-1 and 51-2 may be, for example, a class-A amplifier circuit, a class-B amplifier circuit, or a class-AB amplifier circuit.

The discharge head 300-1 includes a driving signal selection circuit 200 and a plurality of discharging sections 600. The driving signal selection circuit 200 receives the clock signal SCK, print data signal SI1, latch signal LAT1, change signal CH1, driving signals COMA and COMB, and voltage VHV. According to the print data signal SI1, the driving signal selection circuit 200 selects the waveforms of the driving signals COMA1 and COMB1 or leaves these waveforms unselected to create the driving signal VOUT at a time stipulated by the latch signal LAT1 and change signal CH1, after which the driving signal selection circuit 200 outputs the driving signal VOUT to an end of a piezoelectric element 60 included in the corresponding discharging section 600. The reference voltage signal VBS is supplied to another end of the piezoelectric element 60. Thus, the piezoelectric element 60 included in the discharging section 600 is driven by the difference in potential between the driving signal VOUT and the reference voltage signal VBS. When the piezoelectric element 60 is driven, ink is discharged from the discharging section 600.

The ultraviolet irradiation unit 40 irradiates ink landed on the medium with ultraviolet light to fix a dot formed by the ink to the medium. This ultraviolet irradiation unit 40 of this type includes a light source that emits ultraviolet light used to fix ink. Examples of the light source included in the ultraviolet irradiation unit 40 are a light emitting diode (LED), a laser diode (LD), a high-pressure mercury lamp, and a metal halide lamp.

The ultraviolet irradiation unit 40 causes the light source to emit ultraviolet light at a time stipulated by the irradiation control signal UVC received from the control circuit 100 through the branch unit 20 to fix ink, which has been landed on the medium, at a predetermined time. The light source, included in the ultraviolet irradiation unit 40, that emits ultraviolet light is not limited to a light source having a waveform in the ultraviolet region as long as the light source has a waveform with which discharged ink can be appropriately fixed on the medium. The liquid discharging apparatus 1 may have a plurality of ultraviolet irradiation units 40.

The discharge heads 300-2 to 300-4 included in the head unit 30-1 have structures similar to the structure of the discharge head 300-1, so their detailed description will be omitted. When the discharge heads 300-1 to 300-4 do not need to be distinguished, they may be referred to simply as the discharge head 300. The head units 30-2 to 30-5 have structures similar to the structure of the head unit 30-1, so their detailed description will be omitted. When the head units 30-1 to 30-5 do not need to be distinguished, they may be referred to simply as the head unit 30. In this case, it will be assumed in the description below that the head unit 30 receives the clock signal SCK, print data signal SI, latch signal LAT, change signal CH, base driving signals dA and dB, and voltage VHV and that the discharge head 300 receives the clock signal SCK, print data signal SI, latch signal LAT, change signal CH, driving signals COMA and COMB, and voltage VHV. The number of head units 30 included in the liquid discharging apparatus 1 is not limited to 5. Similarly, the number of discharge heads 300 included in the head unit 30 is not limited to 4.

1.2 Functional Structure of the Driving Signal Selection Circuit

Next, the functional structure and operation of the driving signal selection circuit 200 included in the discharge head 300 will be described. First, examples of the waveforms of the driving signals COMA and COMB entered into the driving signal selection circuit 200 and an example of the waveform of the driving signal VOUT output from the driving signal selection circuit 200 will be described before the functional structure and operation of the driving signal selection circuit 200 is described.

Figure 2:
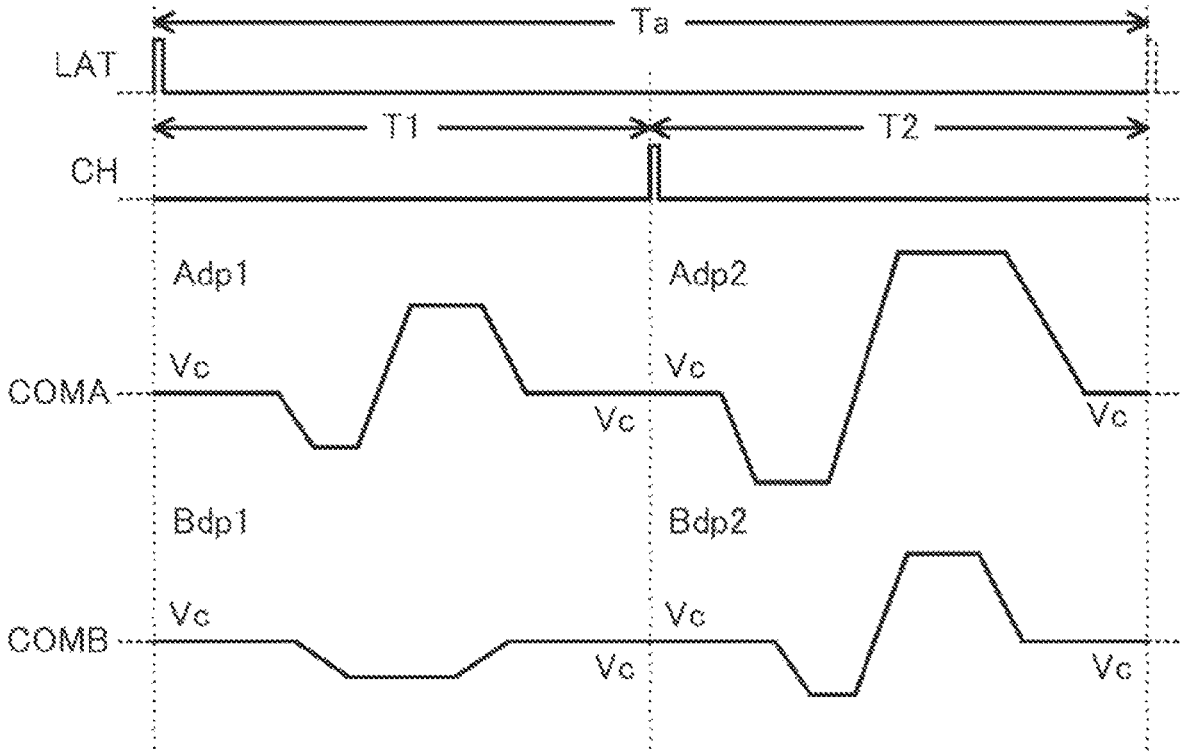
FIG. 2 illustrates examples of the waveforms of driving signals.

FIG. 2 illustrates examples of the waveforms of the driving signals COMA and COMB. As illustrated in FIG. 2, the driving signal COMA has a waveform formed by continuously linking a trapezoidal waveform Adp1 and a trapezoidal waveform Adp2 together; the trapezoidal waveform Adp1 is placed in a period T1 starting from a rising edge of the latch signal LAT and continuing to a rising edge of the change signal CH, and the trapezoidal waveform Adp2 is placed in a period T2 starting from the rising edge of the change signal CH and continuing to a next rising edge of the latch signal LAT. When the trapezoidal waveform Adp1 is supplied to the piezoelectric element 60 included in the discharging section 600, a small amount of ink is discharged from the discharging section 600. When the trapezoidal waveform Adp2 is supplied to the piezoelectric element 60 included in the discharging section 600, a medium amount of ink is discharged from the discharging section 600, the medium amount being larger than the small amount.

Also as illustrated in FIG. 2, the driving signal COMB has a waveform formed by continuously linking a trapezoidal waveform Bdp1 placed in the period T1 and a trapezoidal waveform Bdp2 placed in the period T2 together. When the trapezoidal waveform Bdp1 is supplied to the piezoelectric element 60 included in the discharging section 600, no ink is discharged from the discharging section 600. This trapezoidal waveform Bdp1 is used to cause ink in the vicinity of the opening of the nozzle to undergo micro-vibration to prevent the viscosity of the ink from being increased. When the trapezoidal waveform Bdp2 is supplied to the piezoelectric element 60 included in the discharging section 600, a small amount of ink is discharged from the discharging section 600.

The voltages at the time when the trapezoidal waveform Adp1, Adp2, Bdp1, and Bdp2 start and terminate are the same, that is, a voltage Vc, as illustrated in FIG. 2. That is, the trapezoidal waveforms Adp1, Adp2, Bdp1, and Bdp2 start at the voltage Vc and terminate at the voltage Vc. A cycle Ta constituted by the period T1 and T2, which are interposed between two consecutive rising edges of the latch signal LAT, is equivalent to a print cycle during which a new dot is formed on the medium.

In FIG. 2, the trapezoidal waveform Adp1 and trapezoidal waveform Bdp2 are illustrated as being the same. However, they may be different waveforms. In the description below, it will be assumed that a small amount of ink is discharged from the discharging section 600 when the trapezoidal waveform Adp1 is supplied to the piezoelectric element 60 included in the discharging section 600 and when the trapezoidal waveform Bdp1 is supplied to the piezoelectric element 60 included in the discharging section 600. However, this is not a limitation. That is, the waveforms of the driving signals COMA and COMB are not limited to the waveforms illustrated in FIG. 2. A combination of signals with various waveforms may be used according to, for example, the property of ink discharged from the discharging section 600 or the material of the medium on which ink lands. The driving signal COMA output from the driving signal output circuit 50 included in each of the head units 30-1 to 30-5 may have a different waveform. Similarly, the driving signal COMB output from the driving signal output circuit 50 included in each of the head units 30-1 to 30-5 may have a different waveform.

Figure 3:
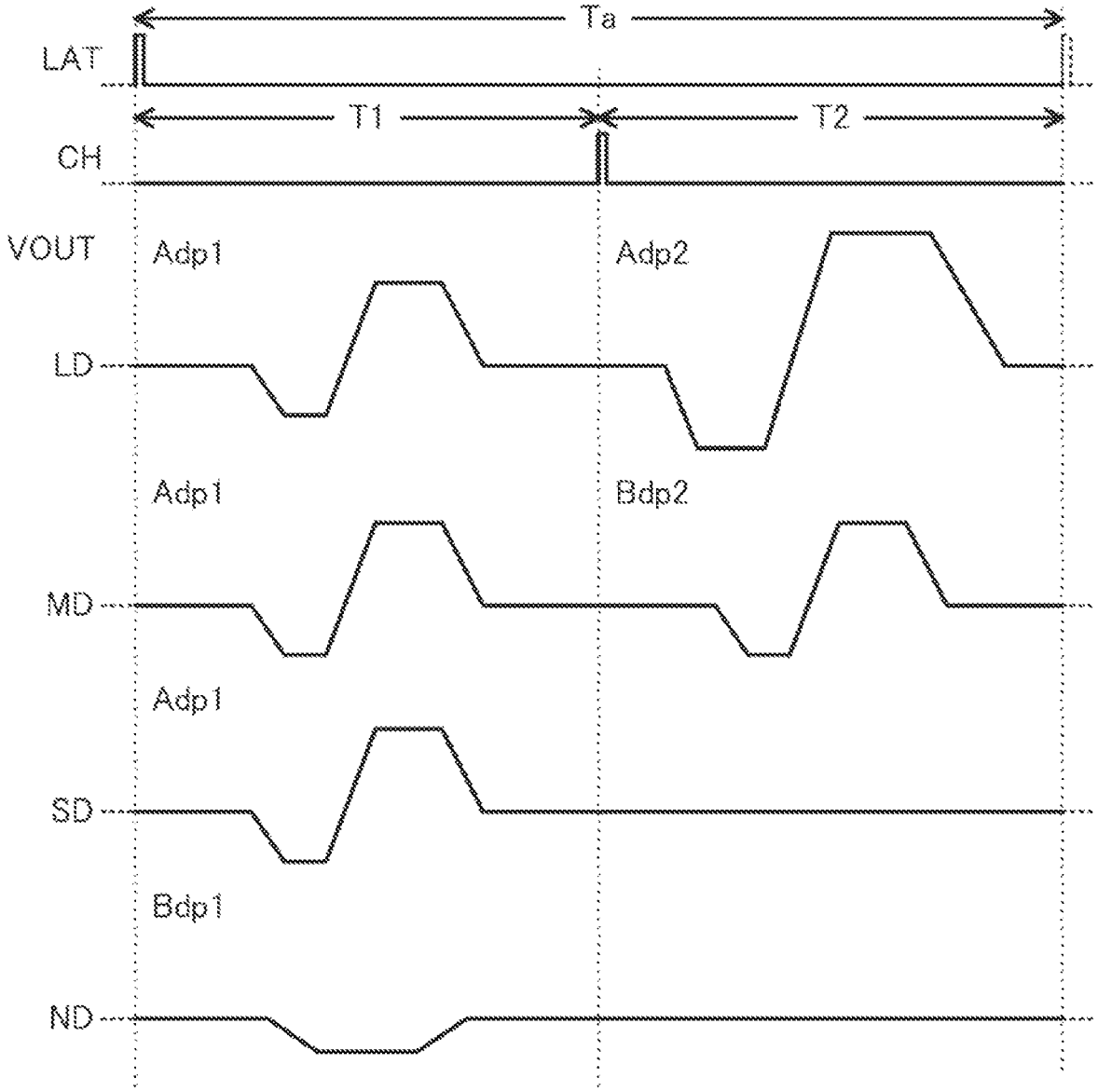
FIG. 3 illustrates examples of the waveforms of another driving signal.

FIG. 3 illustrates examples of the waveforms of the driving signal VOUT when a dot formed on the medium is a large dot LD, a medium dot MD, and a small dot SD and for non-recording ND.

As illustrated in FIG. 3, the driving signal VOUT eligible for forming a large dot LD on the medium has a waveform formed by linking the trapezoidal waveform Adp1 placed in the period T1 and the trapezoidal waveform Adp2 placed in the period T2 together in the cycle Ta. When this driving signal VOUT is supplied to the piezoelectric element 60, a small amount of ink and a medium amount of ink are discharged from the corresponding discharging section 600. When these amounts of ink land on the medium and are combined together, a large dot LD is formed on the medium in the cycle Ta.

The driving signal VOUT eligible for forming a medium dot MD on the medium has a waveform formed by linking the trapezoidal waveform Adp1 placed in the period T1 and the trapezoidal waveform Bdp2 placed in the period T2 together in the cycle Ta. When this driving signal VOUT is supplied to the piezoelectric element 60, a small amount of ink is discharged twice from the corresponding discharging section 600. When these amounts of ink land on the medium and are combined together, a medium dot MD is formed on the medium in the cycle Ta.

The driving signal VOUT eligible for forming a small dot SD on the medium has a waveform formed by linking the trapezoidal waveform Adp1 placed in the period T1 and a waveform placed in the period T2, the waveform being constant at the voltage Vc, together in the cycle Ta. When this driving signal VOUT is supplied to the piezoelectric element 60, a small amount of ink is discharged once from the corresponding discharging section 600. When this ink lands on the medium, a small dot SD is formed on the medium in the cycle Ta.

The driving signal VOUT eligible for non-recording ND in which no dot is formed on the medium has a waveform formed by linking the trapezoidal waveform Bdp1 placed in the period T1 and a waveform placed in the period T2, the waveform being constant at the voltage Vc, together in the cycle Ta. When this driving signal VOUT is supplied to the piezoelectric element 60, ink in the vicinity of the opening of the nozzle in the corresponding discharging section 600 just undergoes micro-vibration and no ink is discharged. Therefore, no ink lands on the medium and no dot is formed on the medium in the cycle Ta.

The waveform constant at the voltage Vc is the waveform of a voltage when under the condition that any of the trapezoidal waveforms Adp1, Adp2, Bdp1, and Bdp2 is not selected as the driving signal VOUT, the immediately preceding voltage Vc of the trapezoidal waveform Adp1, Adp2, Bdp1, or Bdp2 is maintained. Therefore, any of the trapezoidal waveforms Adp1, Adp2, Bdp1, and Bdp2 is not selected as the driving signal VOUT, the voltage Vc is supplied to the piezoelectric element 60 as the driving signal VOUT.

The driving signal selection circuit 200 creates the driving signal VOUT as illustrated in FIG. 3 by selecting the waveforms of the driving signals COMA and COMB as illustrated in FIG. 2 or leaving these waveforms unselected, and outputs the driving signal VOUT to the corresponding discharging section 600.

Figure 4:
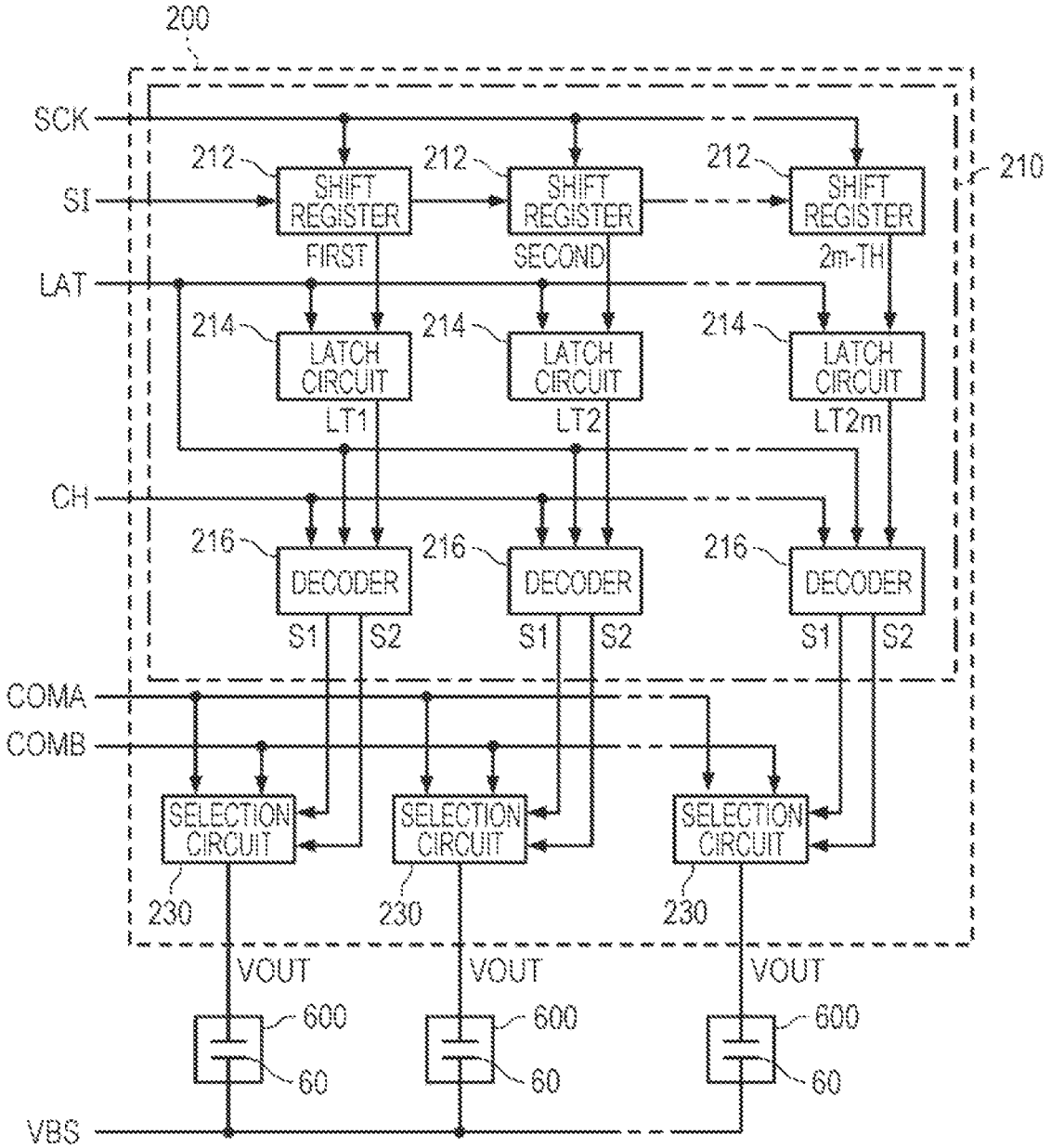
FIG. 4 is a block diagram illustrating the structure of a driving signal selection circuit.

FIG. 4 is a block diagram illustrating the structure of the driving signal selection circuit 200. As illustrated in FIG. 4, the driving signal selection circuit 200 includes a selection control circuit 210 and a plurality of selection circuits 230. The selection control circuit 210 receives the clock signal SCK, print data signal SI, change signal CH, and latch signal LAT. In the selection control circuit 210, a combination of a shift register 212, a latch circuit 214, and a decoder 216 is provided for each of 2m discharging sections 600 corresponding to the driving signal selection circuit 200. That is, the driving signal selection circuit 200 includes as many combinations of the shift register 212, latch circuit 214, and decoder 216 as there are 2m discharging sections 600 included in the discharge head 300.

The print data signal SI, which is entered in synchronization with the clock signal SCK, is a signal of a total of 4m bits including print data items [SIH, SIL], each of which is 2 bits long to select any of the large dot LD, medium dot MD, small dot SD, and non-recording ND for each of the 2m discharging sections 600. The entered print data signal SI is held in the shift registers 212 for each 2-bit print data item [SIH, SIL], included in the print data signal SI, in correspondence with the 2m discharging sections 600. Specifically, in the selection control circuit 210, 2m shift registers 212 are mutually cascaded in correspondence with the 2m discharging sections 600. The print data [SIH, SIL] serially entered as the print data signal SI is sequentially transferred to subsequent shift registers 212 in response to the clock signal SCK. In FIG. 4, the shift registers 212 are denoted "first", "second", . . . , and "2m-th" sequentially from the upstream to which the print data signal SI is entered.

Each of the 2m latch circuits 214 latches the 2-bit print data [SIH, SIL] held in the relevant one of the 2m shift registers 212 on the rising edge of the latch signal LAT.

Figures 5, 6:
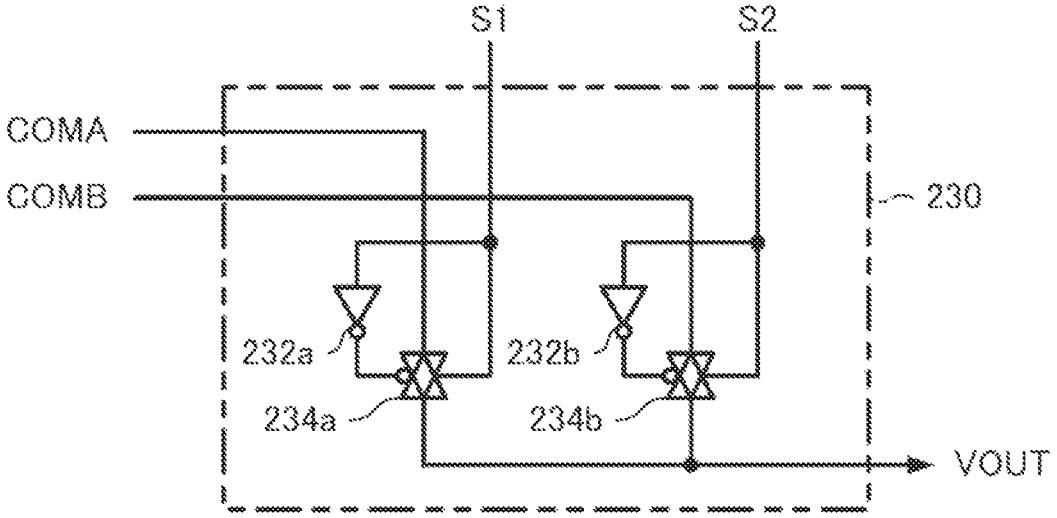
FIG. 5 illustrates decoding by a decoder.
FIG. 6 is a block diagram illustrating the structure of the driving signal selection circuit corresponding to one discharging section.

FIG. 5 illustrates decoding by the decoder 216. The decoder 216 outputs selection signals S1 and S2 according to the latched 2-bit print data [SIH, SIL]. For example, when the 2-bit print data [SIH, SIL] is [1, 0], the decoder 216 outputs the selection signal S1 to the selection circuit 230 so that the logical level of the selection signal S1 is made high in the period T1 and low in the period T2, and also outputs the selection signal S2 to the selection circuit 230 so that the logical level of the selection signal S2 is made low in the period T1 and high in the period T2. The selection signals S1 and S2 output from the decoder 216 have been level-shifted to high-amplitude logic signals by the voltage VHV.

One selection circuit 230 is provided in correspondence with each discharging section 600. That is, the driving signal selection circuit 200 has as many selection circuits 230 as there are 2m discharging sections 600 included in the discharge head 300. FIG. 6 is a block diagram illustrating the structure of the selection circuit 230 corresponding to one discharging section 600. As illustrated in FIG. 6, the selection circuit 230 has inverters 232*a* and 232*b*, which are each a NOT circuit, and transfer gates 234*a* and 234*b*.

The selection signal S1 enters the positive control end, which is not marked with a circle, of the transfer gate 234*a*. The selection signal S1 is also logically reversed by the inverter 232*a* and enters the negative control end, which is marked with a circle, of the transfer gate 234*a*. The driving signal COMA is also supplied to the input end of the transfer gate 234*a*. The selection signal S2 enters the positive control end, which is not marked with a circle, of the transfer gate 234*b*. The selection signal S2 is also logically reversed by the inverter 232*b* and enters the negative control end, which is marked with a circle, of the transfer gate 234*b*. The driving signal COMB is also supplied to the input end of the transfer gate 234*b*. The output ends of transfer gates 234*a* and 234*b* are coupled together and output the driving signal VOUT.

Specifically, the transfer gate 234*a* creates a continuity between its input end and output end when the selection signal S1 is high, and breaks the continuity between the input end and output end when the selection signal S1 is low. Similarly, the transfer gate 234*b* creates a continuity between its input end and output end when the selection signal S2 is high, and breaks the continuity between the input end and output end when the selection signal S2 is low. As described above, the selection circuit 230 selects the waveforms of the driving signals COMA and COMB or leaves these waveforms unselected according to the selection signals S1 and S2, and outputs the driving signal VOUT.

Figure 7:
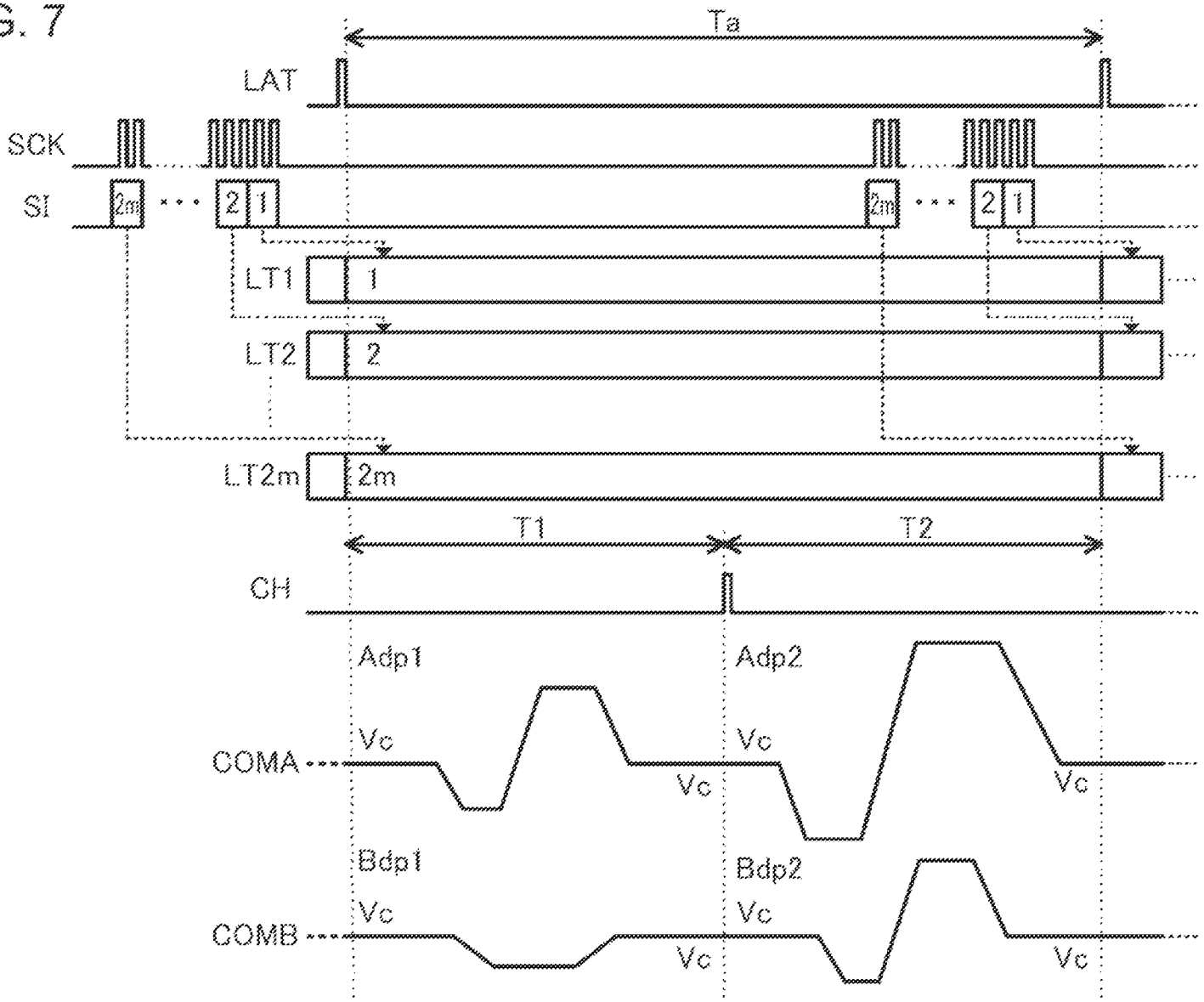
FIG. 7 illustrates how the driving signal selection circuit operates.

The operation of the driving signal selection circuit 200 will be described with reference to FIG. 7. FIG. 7 illustrates how the driving signal selection circuit 200 operates. Print data [SIH, SIL] included in the print data signal SI is serially entered in synchronization with the clock signal SCK, and is sequentially transferred to the shift registers 212 corresponding to the discharging sections 600. When the input of the clock signal SCK is stopped, each shift register 212 holds the 2-bit print data [SIH, SIL] corresponding to the relevant one of the 2m discharging sections 600. The print data items [SIH, SIL] included in the print data signal SI are entered in the order corresponding to the layout of the 2m discharging sections 600 in the shift registers 212; the print data [SIH, SIL] corresponding to the 2m-th discharging section 600 is first entered, the print data [SIH, SIL] corresponding to the second discharging section 600 is entered last but one, and the print data [SIH, SIL] corresponding to the first discharging section 600 is entered last.

When the latch signal LAT is turned on, the latch circuits 214 simultaneously latch the 2-bit print data items [SIH, SIL] held in the shift registers 212. In FIG. 7, LT1, LT2, . . . , and LT2m respectively represent 2-bit print data [SIH, SIL] latched by the latch circuit 214 corresponding to the first, second, . . . , and 2m-th shift registers 212.

In the periods T1 and T2, the decoder 216 outputs the logical levels of the selection signal S1 and S2 as illustrated in FIG. 5, according to the dot sizes indicated by the latched 2-bit print data [SIH, SIL].

Specifically, when the entered print data [SIH, SIL] is [1, 1], the decoder 216 makes the selection signal S1 high in the periods T1 and T2 and makes the selection signal S2 low in the periods T1 and T2. In this case, the selection circuit 230 selects the trapezoidal waveform Adp1 in the period T1 and also selects the trapezoidal waveform Adp2 in the period T2. As a result, the driving signal VOUT corresponding to the large dot LD illustrated in FIG. 3 is created. When the entered print data [SIH, SIL] is [1, 0], the decoder 216 makes the selection signal S1 high in the period T1 and low in the period T2 and makes the selection signal S2 low in the period T1 and high in the period T2. In this case, the selection circuit 230 selects the trapezoidal waveform Adp1 in the period T1 and also selects the trapezoidal waveform Bdp2 in the period T2. As a result, the driving signal VOUT corresponding to the medium dot MD illustrated in FIG. 3 is created. When the entered print data [SIH, SIL] is [0, 1], the decoder 216 makes the selection signal S1 high in the period T1 and low in the period T2 and makes the selection signal S2 low in the periods T1 and T2. In this case, the selection circuit 230 selects the trapezoidal waveform Adp1 in the period T1 and also selects neither trapezoidal waveform Adp2 nor the trapezoidal waveform Bdp2 in the period T2. As a result, the driving signal VOUT corresponding to the small dot SD illustrated in FIG. 3 is created. When the entered print data [SIH, SIL] is [0, 0], the decoder 216 makes the selection signal S1 low in the periods T1 and T2 and makes the selection signal S2 high in the period T1 and low in the period T2. In this case, the selection circuit 230 selects the trapezoidal waveform Bdp1 in the period T1 and also selects neither trapezoidal waveform Adp2 nor the trapezoidal waveform Bdp2 in the period T2. As a result, the driving signal VOUT corresponding to the non-recording ND illustrated in FIG. 3 is created.

As described above, the driving signal selection circuit 200 selects the waveforms of the driving signals COMA and COMB or leaves these waveforms unselected according to the clock signal SCK, print data signal SI, change signal CH, and latch signal LAT, and outputs the selected waveform or waveforms as the driving signal VOUT. Thus, the size of each dot formed on the medium is controlled according to the driving signal VOUT, so the liquid discharging apparatus 1 forms a dot with a desired size on the medium.

The driving signals COMA and COMB output from the driving signal output circuit 50 are examples of a driving signal. The driving signal selection circuit 200 that selectively supplies the driving signals COMA and COMB to the piezoelectric element 60 is an example of a switching circuit. The piezoelectric element 60 driven by the driving signal VOUT based on the driving signal COMA and/or driving signal COMB is an example of a driving element. In consideration that the driving signal VOUT is created as a result of the driving signal selection circuit 200 selecting the waveforms of the driving signals COMA and COMB or leaving these waveforms unselected, the driving signal VOUT can also be regarded as an example of a driving signal.

1.3 Structure of the Liquid Discharging Apparatus

Figure 8:
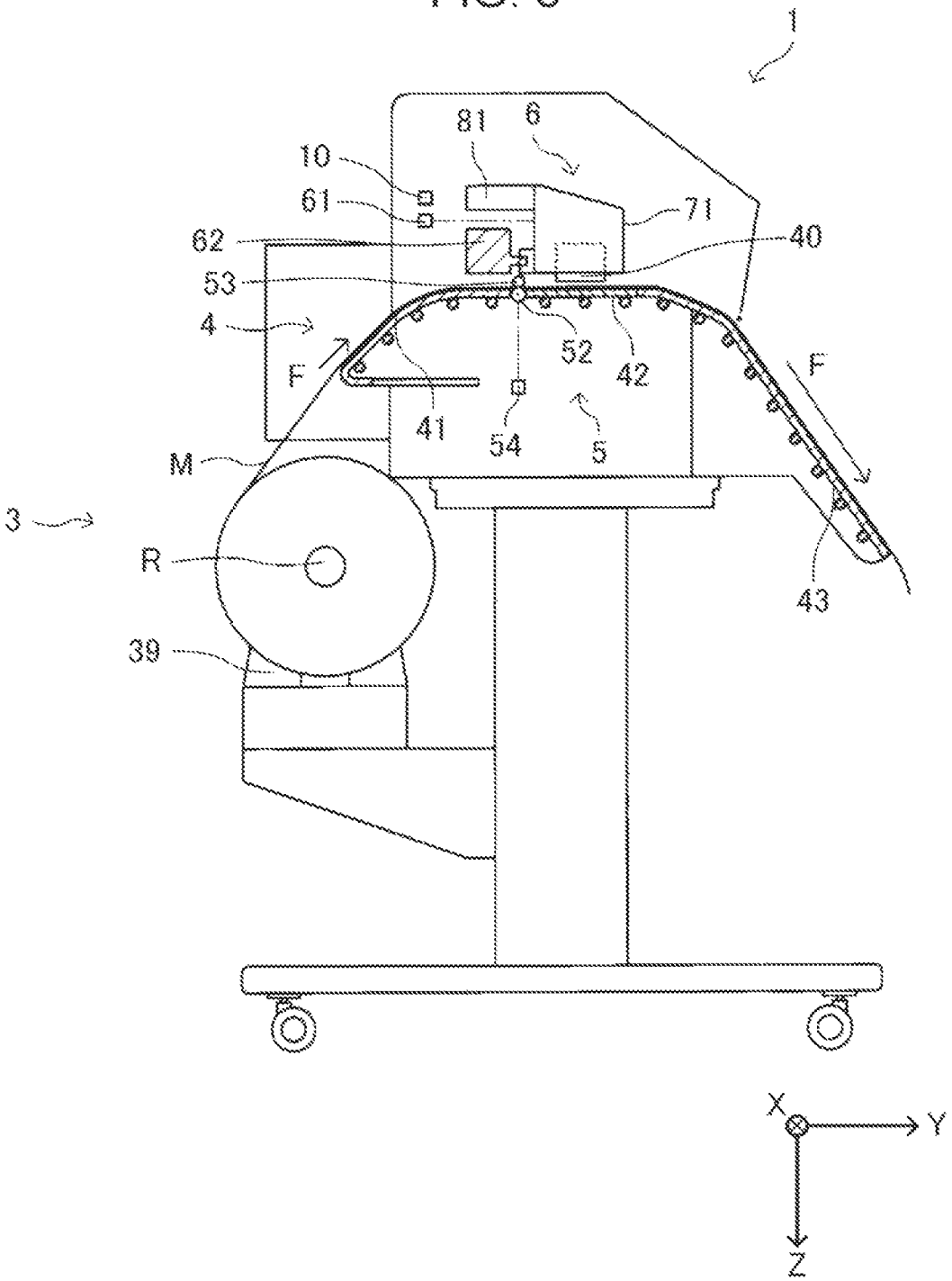
FIG. 8 is a side view illustrating the structure of the liquid discharging apparatus.
Figure 9:
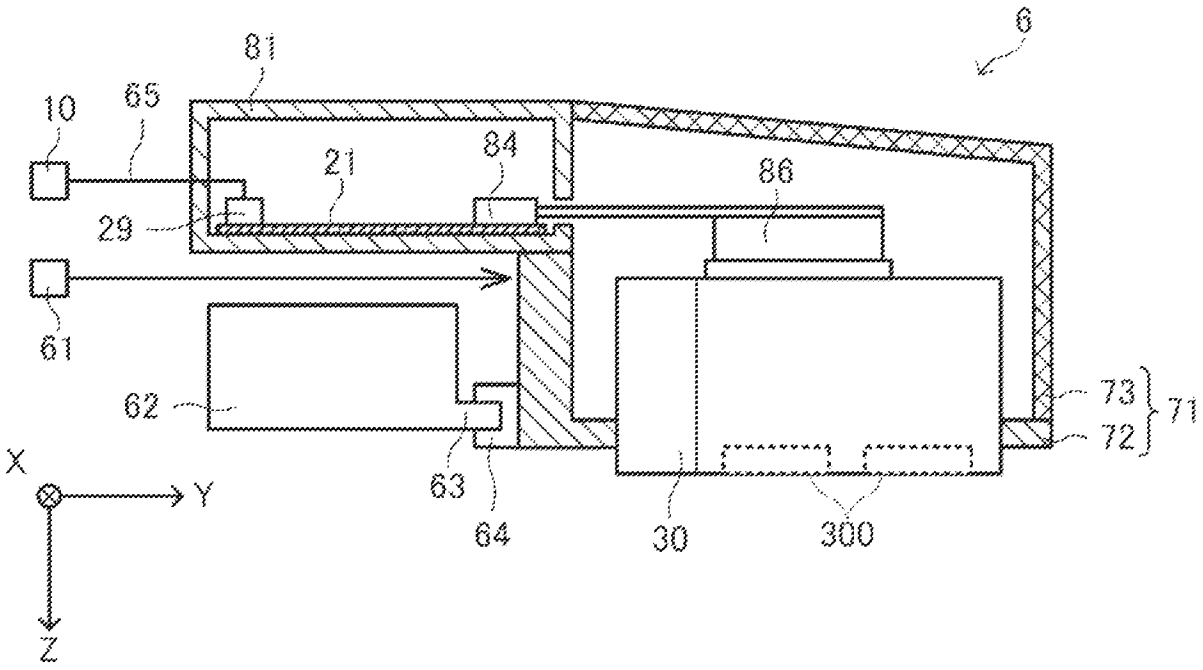
FIG. 9 is a side view illustrating the structure of the periphery of a printing section in the liquid discharging apparatus.
Figure 10:
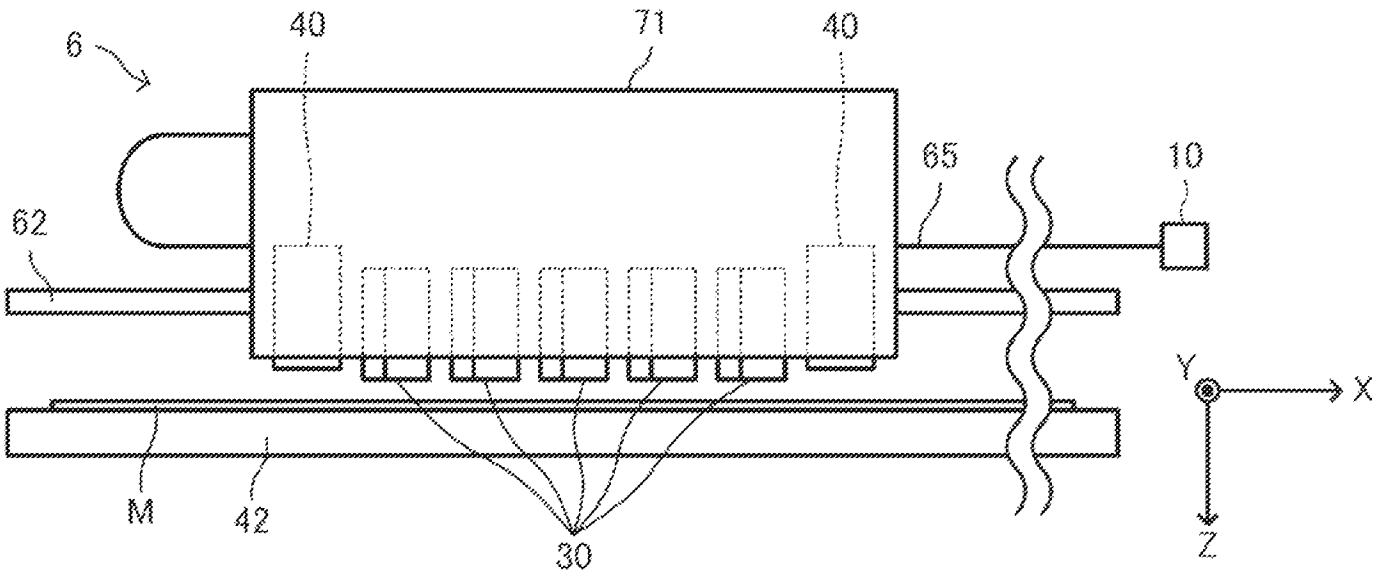
FIG. 10 is a front view illustrating the structure of the periphery of the printing section in the liquid discharging apparatus.
Figure 11:
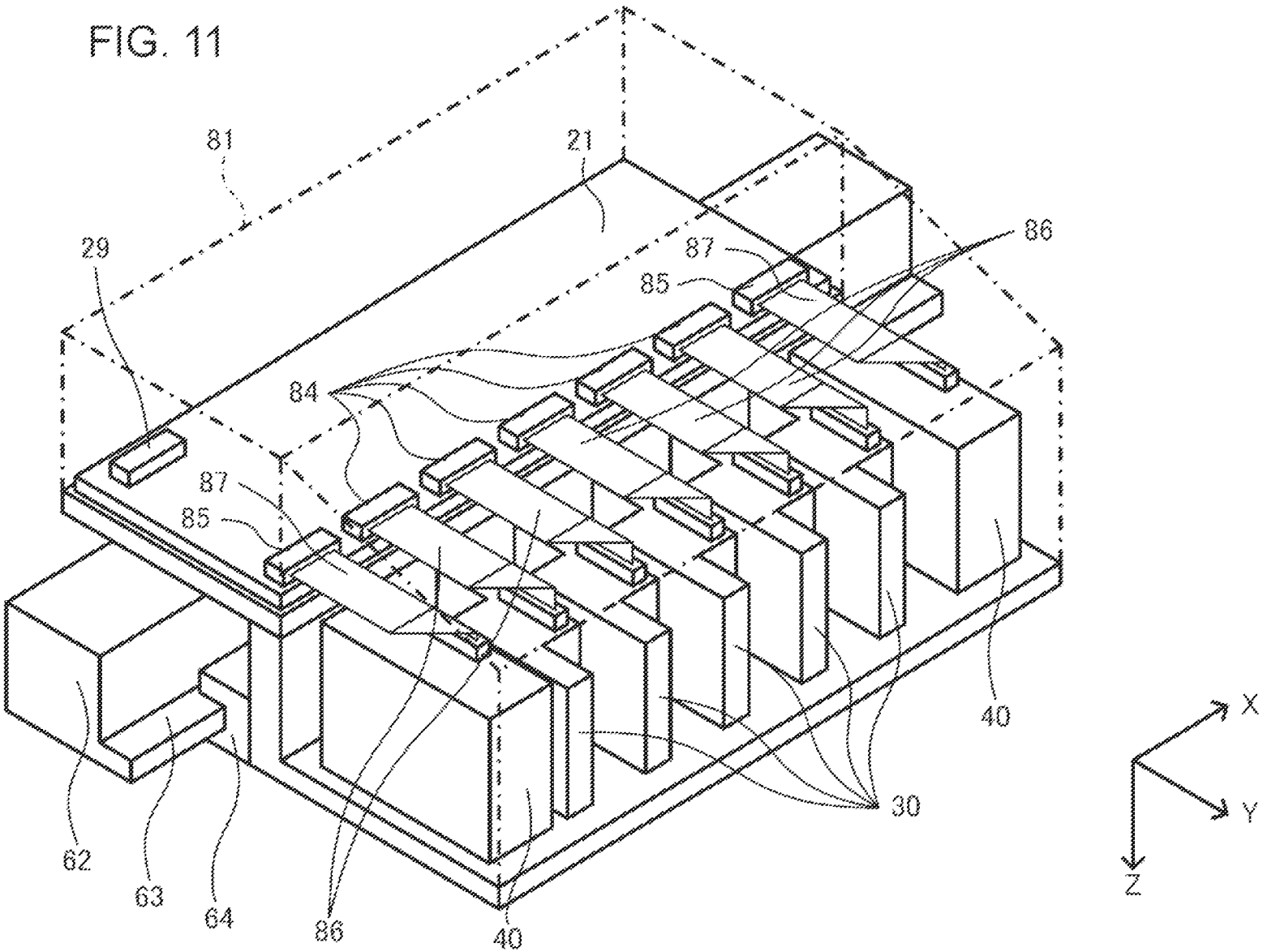
FIG. 11 is a perspective view illustrating the structure of the periphery of the printing section in the liquid discharging apparatus.

Next, the structure of the liquid discharging apparatus 1 will be described with reference to FIGS. 8 to 11. FIG. 8 is a side view illustrating the structure of the liquid discharging apparatus 1. FIG. 9 is a side view illustrating the structure of the periphery of a printing section 6 in the liquid discharging apparatus 1. FIG. 10 is a front view illustrating the structure of the periphery of the printing section 6 in the liquid discharging apparatus 1. FIG. 11 is a perspective view illustrating the structure of the periphery of the printing section 6 in the liquid discharging apparatus 1.

As illustrated in FIG. 8, the liquid discharging apparatus 1 has a feeding section 3 that feeds rolled paper M, which is an example of a medium, a support section 4 that supports the rolled paper M, a transport section 5 that transports the rolled paper M, the printing section 6 that performs printing on the rolled paper M, and a control unit 10 that controls these components. In the description below, the width direction of the liquid discharging apparatus 1 will be referred to as the X direction, the depth direction of the liquid discharging apparatus 1 will be referred to as the Y direction, the height direction of the liquid discharging apparatus 1 will be referred to as the Z direction, and the direction in which the rolled paper M is transported will be referred to as the transport direction F. The X direction, Y direction, and Z direction cross one another. The transport direction F crosses the X direction. Also in the description below, the same side as the starting point of the arrow illustrated in the drawings to indicate the X direction will also be referred to as the −X-direction side, and the same side as the top of the arrow will also be referred to as the +X-direction side; the same side as the starting point of the arrow indicating the Y direction will also be referred to as the −Y-direction side, and the same side as the top of the arrow will also be referred to as the +Y-direction side; the same side as the starting point of the arrow indicating the Z direction will also be referred to as the −Z-direction side, and the same side as the top of the arrow will also be referred to as the +Z-direction side; and the side in the transport direction F on which the rolled paper M is mounted will also be referred to as the upstream, and the opposite side will also be referred to as the downstream.

As illustrated in FIG. 8, the feeding section 3 has a holding member 39 that rotatably holds a roll body R on which the rolled paper M is wound. Any of rolled paper sheets M of different types or in different sizes may be held by the holding member 39. When the feeding section 3 rotates the roll body R in one way under control of the control unit 10, the rolled paper M is fed from the roll body R toward the support section 4.

As illustrated in FIG. 8, the support section 4 has supports 41, 42, and 43, which constitute a transport path through which the rolled paper M is transported from the upstream of the transport direction F toward its downstream. The support 41 guides the rolled paper M fed from the feeding section 3 toward the support 42. The support 42 supports the rolled paper M to which ink is to be discharged. The support 43 guides the rolled paper M to which ink has been discharged toward the downstream of the transport direction F.

As illustrated in FIG. 8, the transport section 5 has a transport roller 52 that exerts a transport force on the rolled paper M, a driven roller 53 that presses the rolled paper M against the transport roller 52, and a rotation mechanism 54 that drives the transport roller 52. The axial direction of the transport roller 52 and driven roller 53 is the X direction.

The transport roller 52 is placed on the +Z side of the transport path of the rolled paper M. The driven roller 53 is placed on the −Z side of the transport path of the rolled paper M. The transport roller 52 and driven roller 53 hold the rolled paper M. The rotation mechanism 54 includes a motor, a reduction gear, and the like, for example. The rotation mechanism 54 is controlled by the control unit 10. When the control unit 10 controls the rotation mechanism 54 with the rolled paper M held between the transport roller 52 and the driven roller 53, the transport section 5 structured as described above transports the rolled paper M along the transport direction F.

As illustrated in FIGS. 9 and 10, the printing section 6 has: a guide member 62 extending in the X direction; a carriage 71 movably supported by the guide member 62; five head units 30, supported by the carriage 71, that discharge ink to the rolled paper M; two ultraviolet irradiation units 40, supported by the carriage 71, that fix, on the rolled paper M, ink discharged to the rolled paper M; and a moving mechanism 61 that bidirectionally moves the carriage 71 in the X direction. The printing section 6 has a case 81 supported by the carriage 71 and also has a relay circuit board 21 accommodated in the case 81.

As illustrated in FIG. 9, the carriage 71 includes: a carriage body 72, the cross section of which is L-shaped as viewed in the X direction; and a carriage cover 73 that forms a closed space together with the carriage body 72 when the carriage cover 73 is removably attached to the carriage body 72. The five head units 30 are supported in the carriage 71 so as to be spaced at substantially equal intervals in the X direction. In this state, each head unit 30 is positioned so that its +Z side protrudes from the bottom surface of the carriage 71 toward the outside. The discharge head 300 including discharging sections 600 that discharge ink to the rolled paper M are positioned in the interior, on the +Z side, of the head unit 30 protruding from the carriage 71. That is, the head unit 30 is placed so that the discharge heads 300, which discharge ink, faces the support 42 by which the rolled paper M is supported with the head unit 30 supported in the carriage 71.

The moving mechanism 61 has a motor and a reduction gear. The moving mechanism 61 converts the rotational force of the motor to a force with which the carriage 71 is moved in the X direction to control the movement of the carriage 71. The motor, reduction gear, and the like included in the moving mechanism 61 of this type are controlled by the control unit 10. That is, when the moving mechanism 61 is controlled by the control unit 10, the carriage 71 bidirectionally moves in the X direction in a state in which the carriage 71 supports the five head units 30.

The case 81 is fixed to the carriage 71 on the −Y side and −Z side of the carriage 71. The relay circuit board 21 is accommodated in the case 81. In other words, the relay circuit board 21 is supported by the carriage 71 with the case 81 intervening between the relay circuit board 21 and the carriage 71.

As illustrated in FIGS. 9 and 11, the relay circuit board 21 has connectors 29, 84, and 85. The connector 29 is coupled to the control unit 10 through a cable 65. The cable 65 of this type electrically couples the relay circuit board 21 supported by the carriage 71, which bidirectionally moves in the X direction, and the control unit 10 fixed to the liquid discharging apparatus 1 together. Therefore, the cable 65 is formed as, for example, a flexible flat cable (FFC) that can be deformed so as to follow the bidirectional movement of the carriage 71. The connector 84 is coupled to the head unit 30 disposed in the carriage 71 through a cable 86. Specifically, connectors 84 are provided on the relay circuit board 21 so that each connector 84 corresponds to one of the head units 30 provided in the carriage 71. The connector 85 is coupled to the ultraviolet irradiation unit 40 disposed in the carriage 71 through a cable 87. Specifically, connectors 85 are provided on the relay circuit board 21 so that each connector 85 corresponds to one of the ultraviolet irradiation unit 40 provided in the carriage 71.

The relay circuit board 21 branches a signal entered from the control unit 10 through the connector 29 and cable 65 to signals in correspondence with the five head units 30, and outputs the branch signals to the five head units 30 through the connectors 84 and cables 86. The relay circuit board 21 also branches another signal to signals in correspondence with the two ultraviolet irradiation units 40, and outputs the branch signals to the two ultraviolet irradiation units 40 through the connectors 85 and cables 87. That is, the relay circuit board 21 that branches a signal from the control unit 10 and outputs the branch signals to the five head units 30 and also branches another signal from the control unit 10 and outputs the branch signals to two ultraviolet irradiation units 40 is equivalent to the branch unit 20 illustrated in FIG. 1A.

Also as illustrated in FIGS. 9 and 11, the guide member 62 integrally has a guide rail 63, which is positioned on the +Y side of the guide member 62 and extends in the X direction. A carriage support section 64, which is movably fitted to the guide rail 63, is positioned at the lower portion of the carriage 71 on the −Y side. When the carriage support section 64 is movably fitted to the guide rail 63, the carriage 71 is supported so as to be movable in the X direction along the guide rail 63 extending in the X direction.

1.4 Structure of the Head Unit 1.4.1 Structure of the Head Unit

Figure 12:
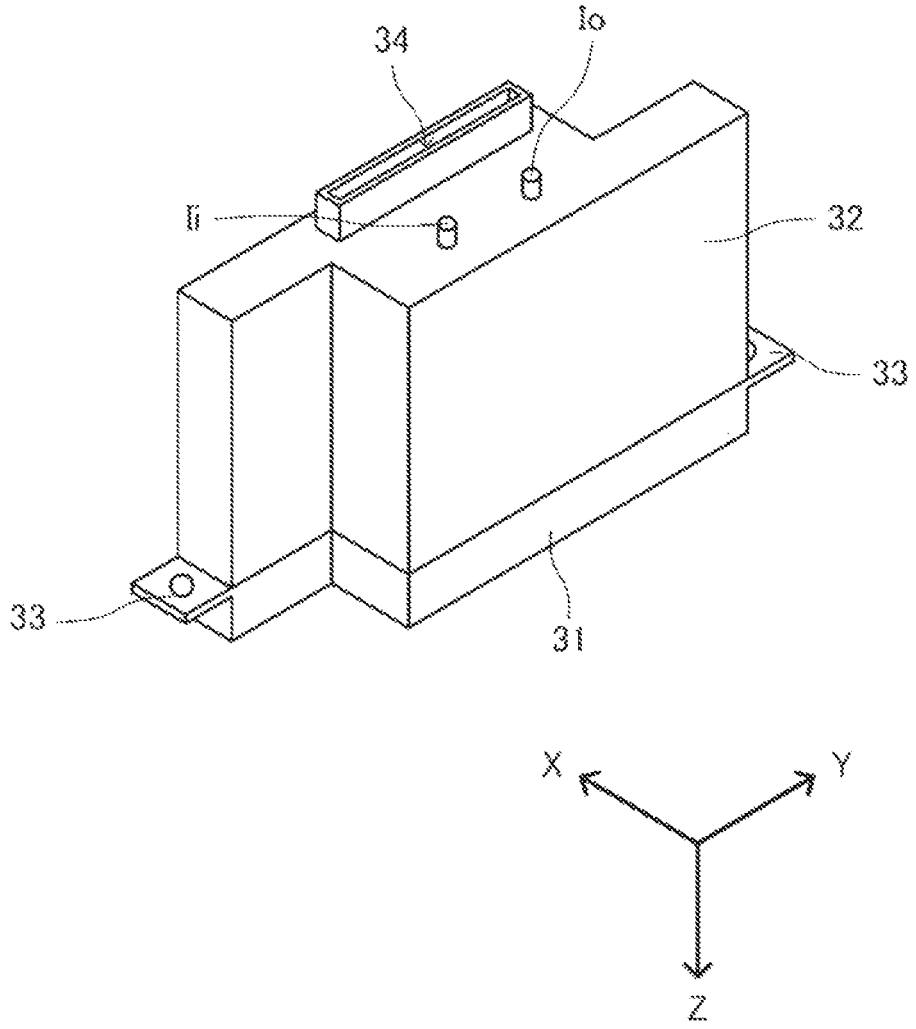
FIG. 12 is a perspective view illustrating a head unit.

Next, the structure of the head unit 30 that discharges ink will be described. FIG. 12 is a perspective view illustrating the head unit 30. As illustrated in FIG. 12, the head unit 30 has a holder 31 and a cover member 32.

Flanges 33 integrally formed with the holder 31 are provided at both ends of the holder 31 in the Y direction, one at each end. Each flange 33 has an insertion hole through which a fixing member such as a screw can be passed. When the flanges 33 are fixed to the carriage body 72 with fixing members such as screws, the head unit 30 is supported by the carriage 71.

On the −Z side of the holder 31, the cover member 32 is disposed on the top of the holder 31 in the vertical direction. The cover member 32 protects ink flow paths and the like through which ink is led into the discharge heads 300 positioned in the head unit 30. An insertion hole 34, through which the cables 86 coupled to the relay circuit board 21 are passed, is formed in the surface of the cover member 32 on the −Z side. An ink inlet Ii, through which ink is led into the discharge heads 300, and an ink outlet Io, through which ink from the discharge heads 300 is ejected, are formed on the −Z side of the cover member 32 and on the −X side of the insertion hole 34. In other words, the head unit 30 has the ink inlet Ii, through which ink to be supplied into the discharge heads 300 flows, and the ink outlet Io, through which ink from the discharge heads 300 is ejected.

That is, the head unit 30 discharges ink led from the ink inlet Ii to the rolled paper M and ejects, from the ink outlet Io, part of ink that was led from the ink inlet Ii but has not been discharged to the rolled paper M, according to signals entered from the control unit 10 through the cable 86 coupled through the insertion hole 34.

Figure 13:
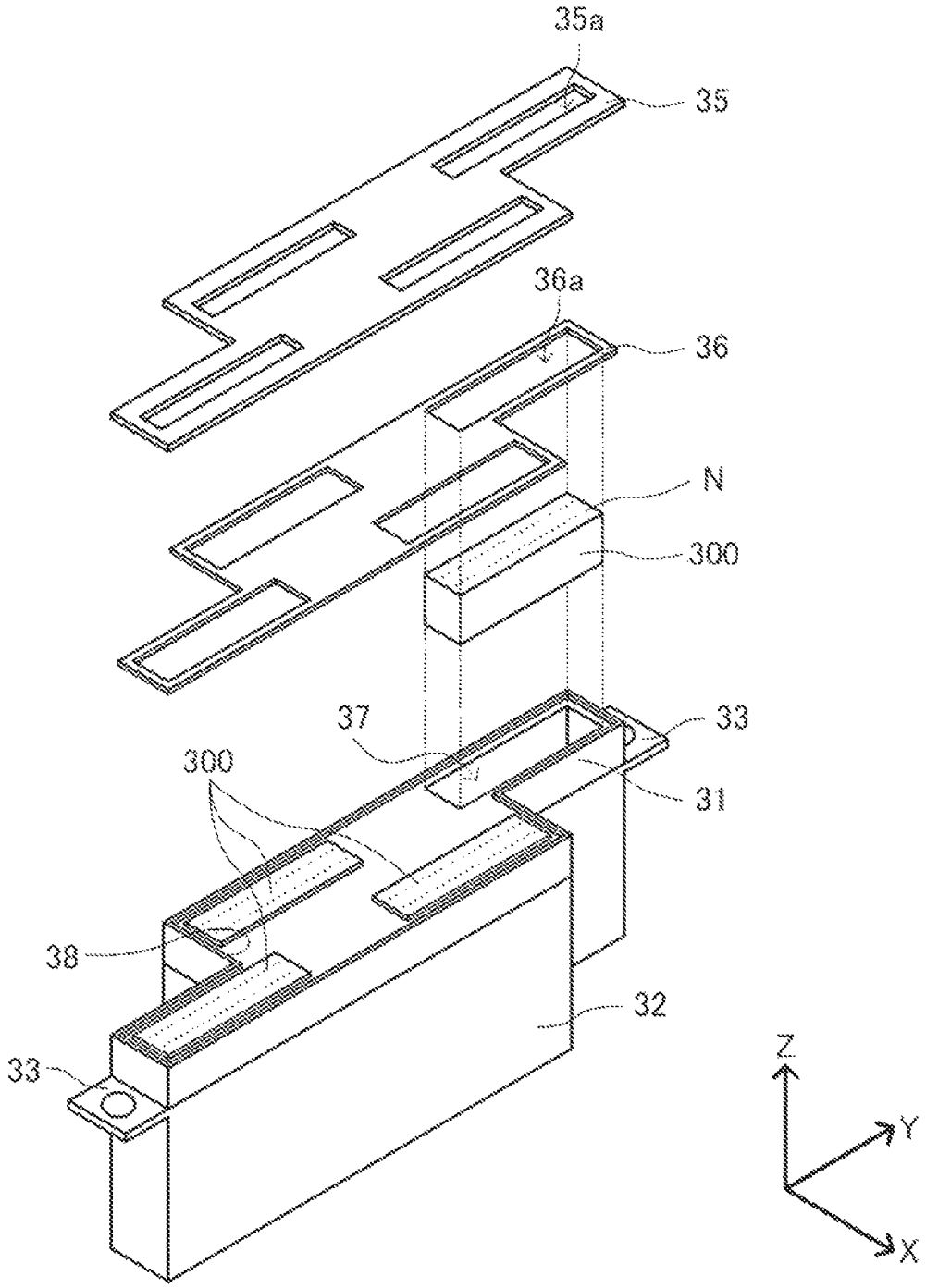
FIG. 13 is an exploded perspective view of the head unit as viewed from the +Z side.

FIG. 13 is an exploded perspective view of the head unit 30 as viewed from the +Z side. As illustrated in FIG. 13, a fixing plate 35, a reinforcing plate 36, and four discharge heads 300 are provided in the holder 31 included in the head unit 30.

The fixing plate 35 is structured by including a plate-like member formed from a conductive material such as a metal. Openings 35*a*, through each of which nozzles N are exposed, are formed in the fixing plate 35, the nozzles N being included in the discharge head 300 to discharge ink. In the fixing plate 35, these openings 35*a* are provided independently so that each fixing plate 35*a* corresponds to one discharge head 300. A nozzle plane of the discharge head 300 is fixed to the periphery of the opening 35*a* in the fixing plate 35 with an adhesive or the like so that the nozzles N are exposed.

The reinforcing plate 36 is positioned on the −Z side of the fixing plate 35. The reinforcing plate 36 is formed from a material having a higher strength than the fixing plate 35. In the reinforcing plate 36, openings 36*a* having an inner circumference larger than the outer circumference of the discharge head 300 are formed at positions at which each openings 36*a* corresponds to the relevant one of the discharge heads 300 joined to the fixing plate 35. The discharge head 300 fixed to the fixing plate 35 passes through the inside of the opening 36*a* in the reinforcing plate 36.

Four accommodating sections 37, which accommodate the four discharge heads 300, are formed in the surface of the holder 31 on the +Z side. Each accommodating section 37 has a concave shape, which is open toward the +Z side of the holder 31. In the accommodating section 37, the relevant discharge head 300 fixed to the fixing plate 35 is accommodated. The opening of the accommodating section 37 is closed by the fixing plate 35. In FIG. 13, the accommodating sections 37 are provided separately for the discharge heads 300, one for each discharge head 300. However, a single accommodating section 37 may accommodate a plurality of discharge heads 300.

A recess 38 having a concave shape, to which the reinforcing plate 36 and fixing plate 35 are fixed, is formed on the surface of the holder 31 on the +Z side. In this recess 38, the reinforcing plate 36 and fixing plate 35 are laminated in succession. The fixing plate 35, reinforcing plate 36, and holder 31 are fitted into the recess 38 by being mutually pressed with a predetermined force in a state in which they are supported by a support tool (not illustrated) or the like. The fixing plate 35, reinforcing plate 36, and holder 31 may be fixed with a fixing member such as, for example, an adhesive.

Figure 14:
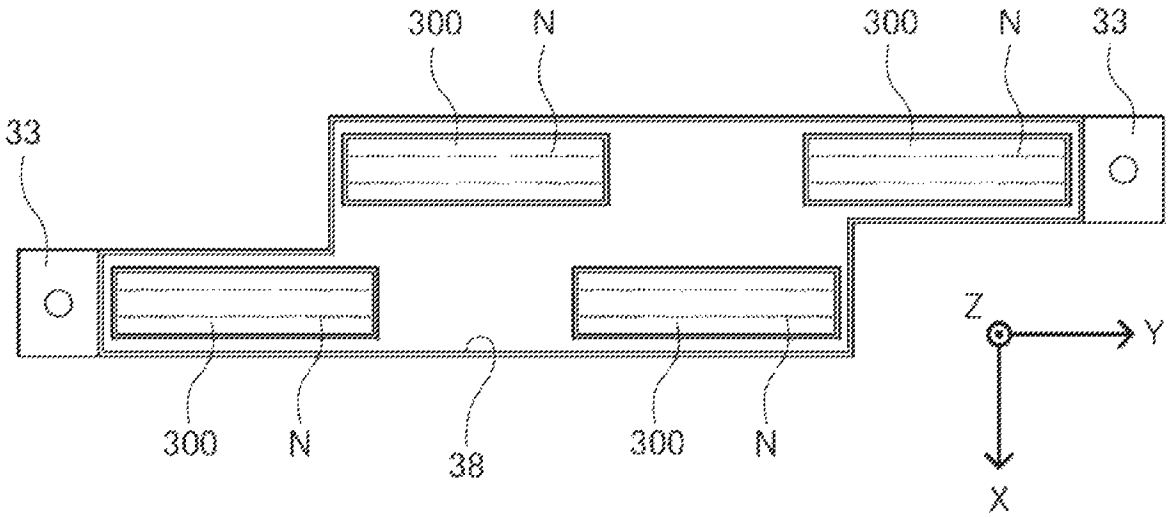
FIG. 14 illustrates an example of a nozzle plane in which nozzles are formed.

FIG. 14 illustrates an example of a nozzle plane in which nozzles N from which ink is discharged are formed. As illustrated in FIG. 14, nozzles N are arranged side by side in the Y direction in the discharge head 300. In the discharge head 300, two rows of nozzles N arranged side by side in the Y direction are provided in the X direction. In the head unit 30, four discharge heads 300 are placed in a staggered arrangement on the surface of the holder 31 on the −Z side. In this arrangement, the four discharge heads 300 are placed so that at least one of the nozzles N included in each of the four discharge heads 300 overlaps a nozzle N in another discharge head 300. The structure of the discharge head 300 will be specifically described later.

1.4.2 Internal Structure of the Head Unit

Figure 15:
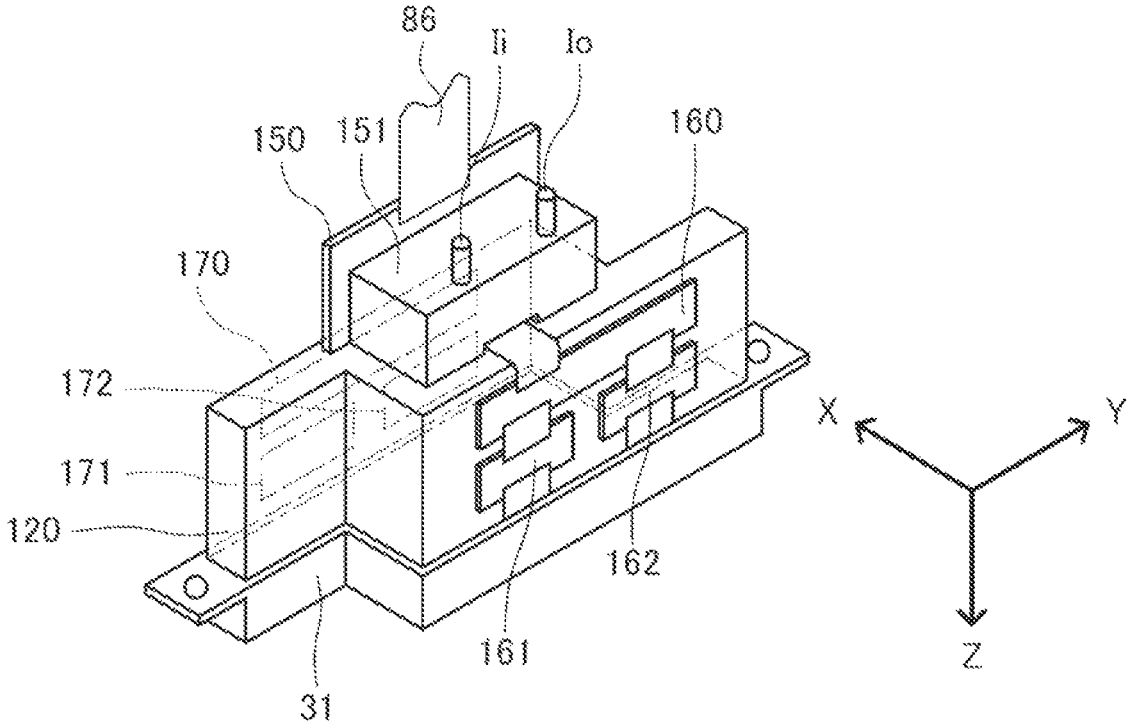
FIG. 15 is a perspective view illustrating the head unit with a cover member removed.
Figure 16:
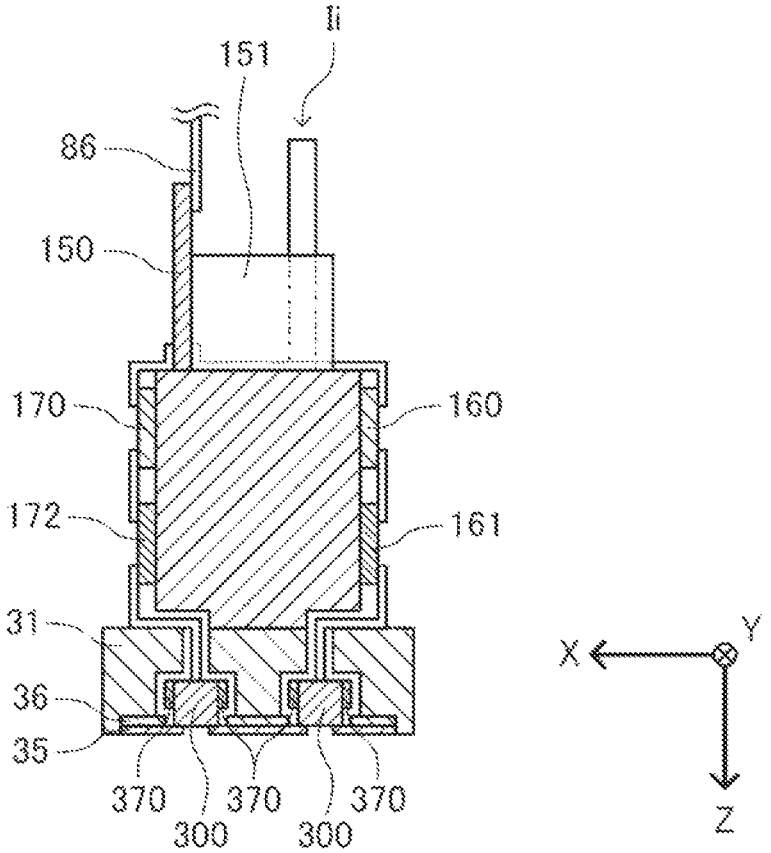
FIG. 16 is a sectional view of the head unit as taken along the X direction so as to pass through an ink inlet.

Next, the internal structure of the cover member 32 of the head unit 30 will be described. FIG. 15 is a perspective view illustrating the head unit 30 with the cover member 32 removed. FIG. 16 is a sectional view of the head unit 30 in FIG. 15 as taken along the X direction so that the head unit 30 is cut so as to pass through the ink inlet Ii. In FIG. 15, wiring boards 170, 171, and 172 provided on the +X side of a flow path member 120 are illustrated by dotted lines.

As illustrated in FIGS. 15 and 16, the head unit 30 has the flow path member 120, wiring boards 150, 160, 161, 162, 170, 171 and 172, and a heat dissipating member 151 inside the cover member 32.

The flow path member 120 is positioned on the −Z side of the holder 31 and on the +Z side of the ink inlet Ii and ink outlet Io. A branch path (not illustrated) communicating with the ink inlet Ii and an ejection path (not illustrated) communicating with the ink outlet Io are formed in the flow path member 120; the branch path braches ink supplied from the ink inlet Ii into the four discharge heads 300, and the ejection path is used to eject at least part of ink supplied from the ink inlet Ii. Since the flow path member 120 has the ejection path through which at least part of ink supplied from the ink inlet Ii is ejected, it is possible to circulate at least part of ink that was supplied from the ink inlet Ii but has not been discharged from the discharge heads 300 and reuse the circulated ink. This can improve the use efficiency of ink in the liquid discharging apparatus 1.

The wiring board 150 is positioned on the −Z side of the flow path member 120 and on the +X side of the ink outlet Io and ink inlet Ii. The wiring board 150 is electrically coupled to the cable 86. Thus, the clock signal SCK, print data signal SI, change signal CH, latch signal LAT, base driving signals dA and dB, and voltage VHV output from the branch unit 20 through the cable 86 are supplied to the wiring board 150.

Of the signals entered through the cable 86, the wiring board 150 braches the clock signal SCK and voltage VHV and outputs them to the wiring boards 160 and 170. Of the print data signals SI, change signals CH, and latch signals LAT entered through the cable 86, the wiring board 150 outputs, to the wiring board 160, the print data signal SI, change signal CH, and latch signal LAT corresponding to two discharge heads 300 positioned side by side in the Y direction on the −X side, and also outputs, to the wiring board 170, the print data signal SI, change signal CH, and latch signal LAT corresponding to two discharge heads 300 positioned side by side in the Y direction on the +X side.

The wiring board 150 also creates the reference voltage signal VBS and the driving signals COMA and COMB respectively based on the base driving signals dA and dB.

The wiring board 150 branches the created driving signals COMA and COMB and reference voltage signal VBS, and outputs them to the wiring boards 160 and 170. That is, the wiring board 150 has the driving signal output circuit 50 that outputs the driving signals COMA and COMB according to the base driving signals dA and dB. This wiring board 150 is an example of a substrate. The structure in which the driving signal output circuit 50 is mounted on the wiring board 150 is an example of a driving circuit board.

As described above, the wiring board 150 branches and then propagates the clock signal SCK, print data signal SI, change signal CH, latch signal LAT, and voltage VHV output from the branch unit 20 through the cable 86 in correspondence with the discharge head 300 included in the head unit 30. The wiring board 150 also creates the driving signals COMA and COMB from the base driving signals dA and dB, after which the wiring board 150 branches and then propagates the created driving signals COMA and COMB and the reference voltage signal VBS in correspondence with the discharge head 300 included in the head unit 30. That is, the wiring board 150 functions as a driving circuit board that creates and outputs the driving signals COMA and COMB and also functions as a relay board that branches and then propagate signals in correspondence with the discharge head 300 included in the head unit 30.

The wiring board 160, positioned on the surface of the flow path member 120 on the −X side, is electrically coupled to the wiring board 150 through a flexible flat cable (FFC) or the like. The wiring board 161 is provided on the surface of the flow path member 120 on the −X side so as to be positioned on +Z side of the wiring board 160 and on the −Y side of the wiring board 162. The wiring board 161 is electrically coupled to the wiring board 160 through an FFC or the like. The wiring board 161 is also electrically coupled to a discharge head 300 positioned on the −Y side, the discharge head 300 being one of the two discharge heads 300 positioned side by side in the Y direction on the −X side. The wiring board 162 is provided on the surface of the flow path member 120 on the −X side so as to be positioned on +Z side of the wiring board 160 and on the +Y side of the wiring board 161. The wiring board 162 is electrically coupled to the wiring board 160 through an FFC or the like. The wiring board 162 is also electrically coupled to a discharge head 300 positioned on the +Y side, the discharge head 300 being one of the two discharge heads 300 positioned side by side in the Y direction on the −X side.

The wiring board 160 receives the clock signal SCK, voltage VHV, driving signals COMA and COMB, and reference voltage signal VBS as well as the print data signal SI, change signal CH, and latch signal LAT corresponding to two discharge heads 300 positioned side by side in the Y direction on the −X side, these signals being part of the print data signals SI, change signals CH, and latch signals LAT output from the wiring board 150. The wiring board 160 then branches the clock signal SCK, voltage VHV, driving signals COMA and COMB, and reference voltage signal VBS, and outputs them to the wiring boards 161 and 162. The wiring board 160 also outputs, to the wiring board 161, the print data signal SI, change signal CH, and latch signal LAT corresponding to a discharge head 300 positioned on the −Y side, the discharge head 300 being one of the two discharge heads 300 positioned side by side in the Y direction on the −X side. Similarly, the wiring board 160 outputs, to the wiring board 162, the print data signal SI, change signal CH, and latch signal LAT corresponding to the other discharge head 300 positioned on the +Y side.

The wiring board 170, positioned on the surface of the flow path member 120 on the +X side, is electrically coupled to the wiring board 150 through an FFC (not illustrated) or the like. The wiring board 171 is provided on the surface of the flow path member 120 on the +X side so as to be positioned on +Z side of the wiring board 170 and on the −Y side of the wiring board 172. The wiring board 171 is electrically coupled to the wiring board 170 through an FFC (not illustrated) or the like. The wiring board 171 is also electrically coupled to a discharge head 300 positioned on the −Y side, the discharge head 300 being one of the two discharge heads 300 positioned side by side in the Y direction on the +X side. The wiring board 172 is provided on the surface of the flow path member 120 on the +X side so as to be positioned on +Z side of the wiring board 170 and on the +Y side of the wiring board 171. The wiring board 172 is electrically coupled to the wiring board 170 through an FFC (not illustrated). The wiring board 172 is also electrically coupled to a discharge head 300 positioned on the +Y side, the discharge head 300 being one of the two discharge heads 300 positioned side by side in the Y direction on the +X side.

The wiring board 170 receives the clock signal SCK, voltage VHV, driving signals COMA and COMB, and reference voltage signal VBS as well as the print data signal SI, change signal CH, and latch signal LAT corresponding to two discharge heads 300 positioned side by side in the Y direction on the +X side, these signals being part of the print data signals SI, change signals CH, and latch signals LAT output from the wiring board 150. The wiring board 170 then branches the clock signal SCK, voltage VHV, driving signals COMA and COMB, and reference voltage signal VBS, and outputs them to the wiring boards 171 and 172. The wiring board 170 also outputs, to the wiring board 171, the print data signal SI, change signal CH, and latch signal LAT corresponding to a discharge head 300 positioned on the −Y side, the discharge head 300 being one of the two discharge heads 300 positioned side by side in the Y direction on the +X side. Similarly, the wiring board 170 outputs, to the wiring board 172, the print data signal SI, change signal CH, and latch signal LAT corresponding to the other discharge head 300 positioned on the +Y side.

The heat dissipating member 151 is positioned on the −Z side of the flow path member 120 and is coupled to the wiring board 150 or the driving signal output circuit 50 mounted on the wiring board 150. As described above, the wiring board 150 has the driving signal output circuit 50 that outputs the driving signals COMA and COMB to be supplied to the four discharge heads 300 included in the head unit 30. This driving signal output circuit 50 included in the wiring board 150 outputs the driving signal COMA and COMB including a current that can drive all piezoelectric elements 60 included in the discharging sections 600 disposed in the four discharge heads 300. That is, the driving signal output circuit 50 included in the wiring board 150 outputs signals at a very large current. Therefore, the driving signal output circuit 50 may generate a large amount of heat. The heat dissipating member 151 transfers heat generated by the driving signal output circuit 50 of this type to reduce the risk that the temperature of the driving signal output circuit 50 is raised.

To form the heat dissipating member 151 of this type, a material having high thermal conductivity can be used. The heat dissipating member 151 may include a metal material such as, for example, aluminum, iron, or copper. Alternatively, the heat dissipating member 151 may be formed by using a Peltier element or the like. In FIGS. 15, 16 and other drawings, the heat dissipating member 151 is illustrated as being a substantially rectangular parallelepiped. However, the shape of the heat dissipating member 151 is not limited to a substantially rectangular parallelepiped. For example, the heat dissipating member 151 may partially have an arc or may have a plurality of fins as with a heat sink.

In coupling between the heat dissipating member 151 and the wiring board 150 or driving signal output circuit 50, the heat dissipating member 151 may be coupled to the wiring board 150 or driving signal output circuit 50 so that the heat dissipating member 151 is placed in direct contact with the wiring board 150 or driving signal output circuit 50. Alternatively, the heat dissipating member 151 may be coupled to the wiring board 150 or driving signal output circuit 50 through a cable such as an FFC and electric parts or through a fixing member such as an adhesive. That is, in coupling between the heat dissipating member 151 and the wiring board 150 or driving signal output circuit 50, the heat dissipating member 151 may be placed in contact with the wiring board 150 or driving signal output circuit 50, or may be coupled to the wiring board 150 or driving signal output circuit 50 through a cable and electric parts or through a fixing member such as an adhesive. In other words, coupling between the heat dissipating member 151 and the wiring board 150 or driving signal output circuit 50 includes thermal coupling between the heat dissipating member 151 and the wiring board 150 or driving signal output circuit 50 through solids or a liquid.

On the wiring board 150, on which the driving signal output circuit 50 is mounted, the heat dissipating member 151 may be coupled to a line at a certain potential such as circuit ground.

This line at a certain potential such as circuit ground occupies a wide area on the wiring board 150, on which the driving signal output circuit 50 is mounted. When the heat dissipating member 151 is coupled to this type of line occupying a wide area, the heat dissipating member 151 can efficiently transfer heat generated at the wiring board 150, on which the driving signal output circuit 50 is mounted. The certain potential of the line is not limited to circuit ground. For example, the certain potential may be earth potential or the potential of frame ground.

In addition, at least part of the heat dissipating member 151 is coupled to the flow path member 120, ink inlet Ii, and ink outlet Io. Thus, heat generated at the driving signal output circuit 50 is transferred by the heat dissipating member 151 and is added to ink flowing through the flow path member 120, ink inlet Ii, and ink outlet Io.

UV curable ink used in the liquid discharging apparatus 1 in the first embodiment has a low fluidity at low temperatures. Therefore, when the UV curable ink is used at a low temperature, the discharge property of ink from the discharging section 600 may be deteriorated. In view of this, the liquid discharging apparatus 1 using UV curable ink has a heater that heats the UV curable ink. When the UV curable ink is heated by the heater, the fluidity of the ink is creased, improving precision with which ink is discharged from the discharging section 600.

In view of the above situation, the liquid discharging apparatus 1 in the first embodiment can heat ink flowing through the flow path member 120 and ink inlet Ii by causing the heat dissipating member 151 to transfer heat generated at the driving signal output circuit 50 to the flow path member 120 and ink inlet Ii. This can reduce consumption of energy used to heat the ink. That is, the energy efficiency of the liquid discharging apparatus 1 can be enhanced.

Furthermore, the liquid discharging apparatus 1 in the first embodiment can heat ink ejected from the discharge head 300 by causing the heat dissipating member 151 to transfer heat generated at the driving signal output circuit 50 to the flow path member 120 and ink outlet Io. This can enhance the circulation efficiency of ink circulating in the liquid discharging apparatus 1. As a result, the energy efficiency of the liquid discharging apparatus 1 can be further enhanced.

In coupling between the heat dissipating member 151 and the flow path member 120, ink inlet Ii and ink outlet Io, the heat dissipating member 151 may be coupled to the flow path member 120, ink inlet Ii, and ink outlet Io so that the heat dissipating member 151 is placed in direct contact with the flow path member 120, ink inlet Ii, and ink outlet Io. Alternatively, the heat dissipating member 151 may be coupled to the flow path member 120, ink outlet Io, and ink inlet Ii through a cable such as an FFC and electric parts or through a fixing member such as an adhesive. That is, in coupling between the heat dissipating member 151 and the flow path member 120, ink outlet Io and ink inlet Ii, the heat dissipating member 151 may be placed in contact with the flow path member 120, ink outlet Io, and ink inlet Ii, or may be coupled to the flow path member 120, ink outlet Io, and ink inlet Ii through a cable and electric parts or through a fixing member such as an adhesive. In other words, coupling between the heat dissipating member 151 and the flow path member 120, ink outlet Io and ink inlet Ii includes thermal coupling between the heat dissipating member 151 and the flow path member 120, ink outlet Io and ink inlet Ii through solids or a liquid.

Although, in FIGS. 15 and 16, the ink inlet Ii and ink outlet Io pass through the heat dissipating member 151, this is not a limitation. It is only necessary that heat generated at the driving signal output circuit 50 can be transmitted through the heat dissipating member 151 to ink passing through the ink inlet Ii and ink outlet Io. Therefore, it is only necessary that at least part of the heat dissipating member 151 is terminally coupled to at least part of the ink inlet Ii and at least part of the ink outlet Io.

The ink inlet Ii through which ink to be supplied to the nozzle N included in the discharge head 300 flows is an example of a first flow path member. The ink outlet Io through which ink ejected from the discharge head 300 passes is an example of a second flow path member. The flow path member 120 having a branch path through which ink supplied from the ink inlet Ii is supplied to the nozzles N included in the discharge head 300 is another example of the first flow member. The flow path member 120 having an ejection flow path through which ink ejected from the discharge heads 300 is ejected to the ink outlet Io is another example of the second flow path member. The heat dissipating member 151 is an example of a first heat dissipating member.

As illustrated in FIG. 16, the discharge head 300 has a temperature adjusting section 370. This temperature adjusting section 370 includes a temperature measuring section 374, illustrated in FIG. 18, that measures the temperature of ink to be discharged from the discharge head 300, and also includes a heat generating section 372 that heats ink to be discharged from the discharge head 300, the ink being heated according to the result of temperature measurement by the temperature measuring section 374.

The temperature measuring section 374 included in the temperature adjusting section 370 is structured by including a semiconductor element such as a diode having a temperature property or a thermistor having a temperature-varying property, for example. The temperature measuring section 374, which is placed in the vicinity of the discharge head 300, calculates the temperature of ink flowing in the discharge head 300. The heat generating section 372 is structured by including a heat-generating element such as a resistive element or transistor, for example. The heat generating section 372 generates heat according to the ink temperature calculated according to the result of the measurement by the temperature measuring section 374. Since the temperature adjusting section 370 is placed in the vicinity of the discharge head 300, ink to be discharged from the discharge head 300 can be adjusted to an optimum temperature. Therefore, it is possible to further improve precision with which ink is discharged from the discharge head 300.

As illustrated in FIG. 16, the temperature adjusting section 370 of this type that adjusts the temperature of ink to be discharged is preferably positioned downstream of a coupled portion at which the heat dissipating member 151 and ink inlet Ii are coupled together on an ink supply path through which ink is supplied from the ink inlet Ii toward the nozzle N from which ink is discharged, that is, on the same side as the discharge head 300 and on the same side as the nozzle N. Thus, the temperature of ink can be adjusted immediately before ink is discharged from the discharge head 300, and the ink can thereby be adjusted to an optimum temperature independently of the state of the ink heated by the heat dissipating member 151. Therefore, it is possible to further improve precision with which ink is discharged from the discharge head 300.

1.4.3 Structure of the Discharge Head

Figure 17:
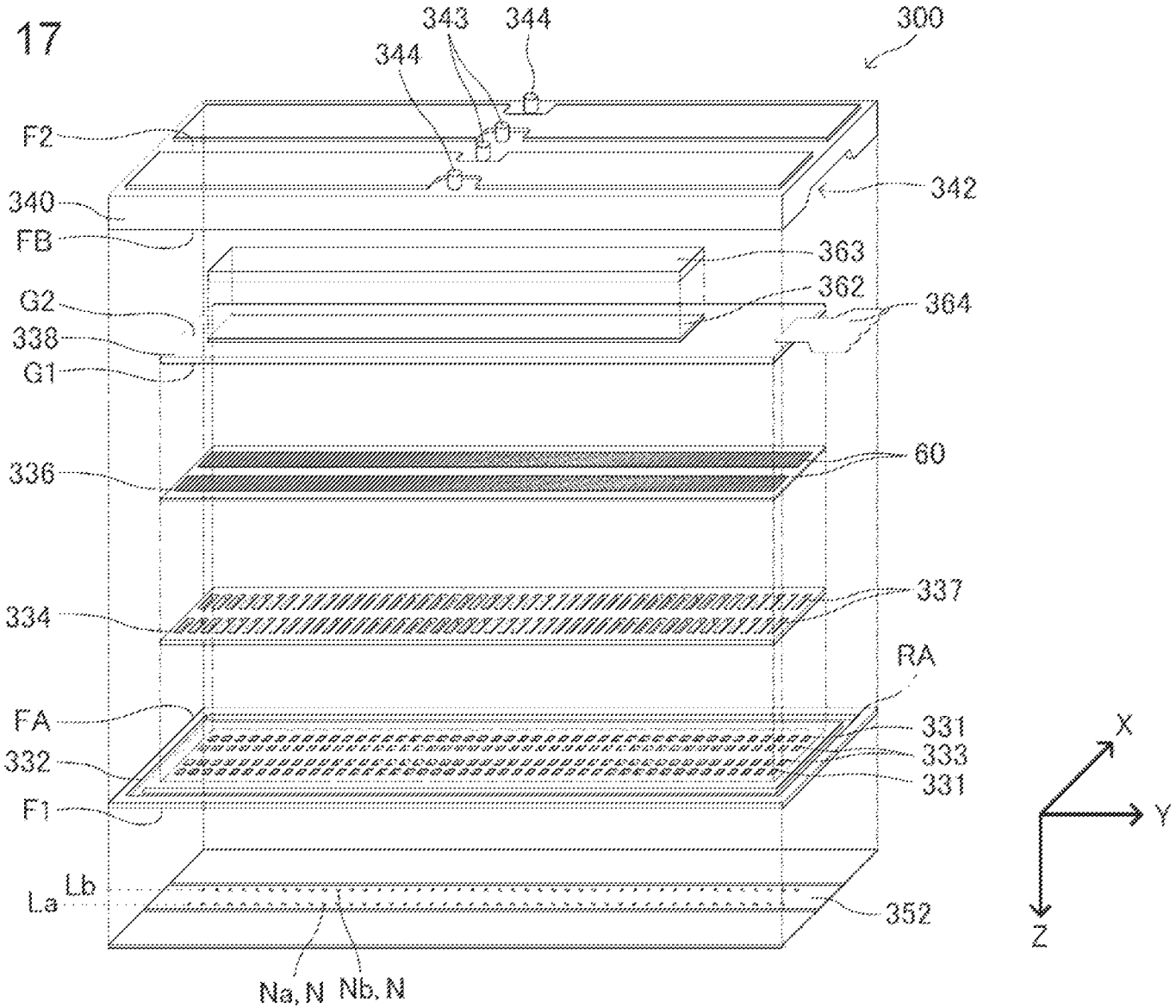
FIG. 17 is an exploded perspective view of a discharge head.
Figure 18:
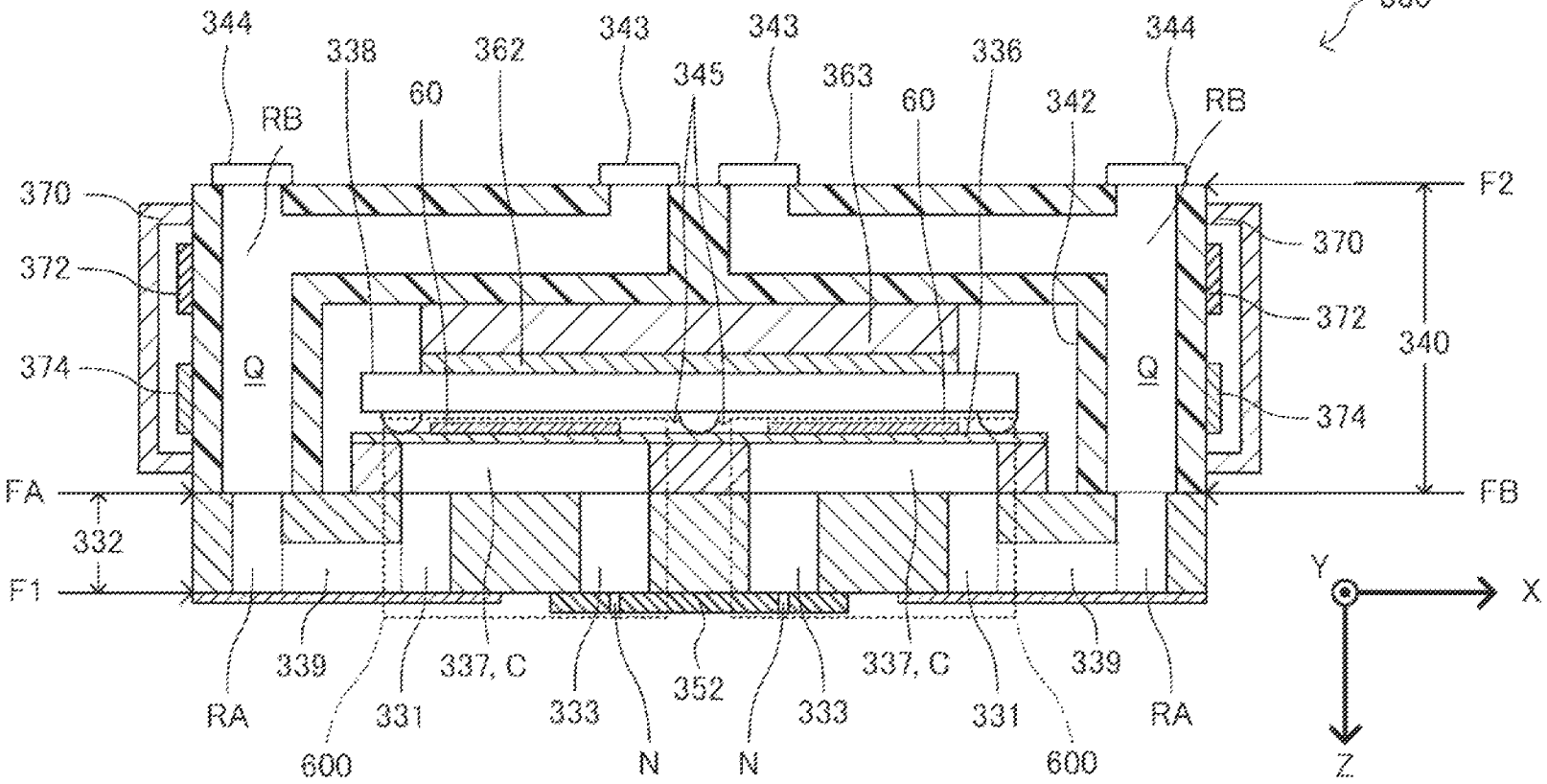
FIG. 18 is a sectional view of the discharge head as taken along the X direction so as to pass through inlets and outlets.

Next, the structure of the discharge head 300 will be described with reference to FIGS. 17 and 18. FIG. 17 is an exploded perspective view of the discharge head 300. FIG. 18 is a sectional view of the discharge head 300 as taken along the X direction so as to pass through inlets 343 and outlets 344. As illustrated in FIGS. 17 and 18, the discharge head 300 includes: the piezoelectric element 60 driven by the driving signal VOUT based on the driving signal COMA and/or driving signal COMB; an integrated circuit 362 including the driving signal selection circuit 200 that selects whether to supply the driving signal VOUT based on the driving signal COMA and/or driving signal COMB to the piezoelectric element 60; and a nozzle board 352 in which nozzles N are formed, the nozzles N discharging ink by being driven by the piezoelectric element 60. The nozzle board 352 is an example of a nozzle plate.

As illustrated in FIG. 17, the discharge head 300 has 2m nozzles N arranged side by side in the Y direction. In the first embodiment, the 2m nozzles N are arranged in two rows, row La and row Lb. In the description below, each of the m nozzles N in the row La may be referred to as the nozzle Na, and each of the m nozzles N in the row Lb may be referred to as the nozzle Nb. It will be also assumed that there is an approximate match in position in the Y direction between an i-th nozzle Na (i is a natural number larger than or equal to 1 and smaller than or equal to m) of the m nozzles Na in the row La and an i-th nozzle Nb of the m nozzles Nb in the row Lb. Here, "approximate match" includes not only a complete match but also a case in which the two positions can be regarded as being the same when error is considered. However, the 2m nozzles N may be arranged so that there is a mismatch in position in the Y direction between the i-th nozzle Na of the m nozzles Na in the row La and the i-th nozzle Nb of the m nozzles Nb in the row Lb, that is, may be in a so-called staggered arrangement.

As illustrated in FIGS. 17 and 18, the discharge head 300 has a flow path substrate 332, which is a plate-like member including a plane F1 and a plane FA. The plane F1 is the surface of the flow path substrate 332 on the +Z side, and the plane FA is the surface of the flow path substrate 332 on the −Z side. A pressure chamber substrate 334, an actuator substrate 336, a plurality of piezoelectric elements 60, a wiring board 338, and a case 340 are provided on the plane FA. The nozzle board 352 is provided on the plane F1. The constituent elements of the discharge head 300 are generally a plate-like member elongated in the Y direction. They are laminated in the Z direction.

In the nozzle board 352, 2m nozzles N, each of which is a through-hole, are formed. In the description below, a surface of the nozzle board 352, the surface facing the outside of the discharge head 300, is equivalent to the nozzle plane.

As illustrated in FIGS. 17 and 18, a flow path RA is formed in the flow path substrate 332. Also, 2m flow paths 331 and 2m flow paths 333 are formed in the flow path substrate 332 so as to be in one-to-one correspondence with the 2m nozzles N. The flow path 331 and flow path 333 are each an opening formed so as to pass through the flow path substrate 332 as illustrated in FIG. 18. The flow path 333 communicates with its corresponding nozzle N. Two flow paths 339 are also formed above the plane F1 of the flow path substrate 332. One of the two flow paths 339 links the flow path RA and m flow paths 331, which are in one-to-one correspondence with the m nozzles Na in the row La, together. The other of the two flow paths 339 links the flow path RA and m flow paths 331, which are in one-to-one correspondence with the m nozzles Nb in the row Lb, together.

As illustrated in FIGS. 17 and 18, 2m openings 337 are formed in the pressure chamber substrate 334 so as to be in one-to-one correspondence with the 2m nozzles N. The actuator substrate 336 is provided on a surface of the pressure chamber substrate 334, the surface being opposite to the flow path substrate 332, that is, on the −Z side. As illustrated in FIG. 18, the actuator substrate 336 and the plane FA of the flow path substrate 332 face each other with clearances between the actuator substrate 336 and the plane FA in the openings 337. A space formed between the actuator substrate 336 and the plane FA of the flow path substrate 332 in the opening 337 functions as a cavity C used to apply pressure to ink supplied into the space. The cavity C is a space the short-side direction of which is the X direction and the long-side direction of which is the Y direction. In the discharge head 300, 2m cavities C are formed so as to be in one-to-one correspondence with the 2m nozzles N. A cavity C formed so as to be in correspondence with a nozzle Na communicates with the flow path RA through the relevant flow path 331 and flow path 339 and also communicates with the nozzle Na through the relevant flow path 333. Similarly, a cavity C formed so as to be in correspondence with a nozzle Nb communicates with the flow path RA through the relevant flow path 331 and flow path 339 and also communicates with the nozzle Nb through the relevant flow path 333.

As illustrated in FIGS. 17 and 18, 2m piezoelectric elements 60 are provided on the surface of the actuator substrate 336, the surface being opposite to the cavities C, that is, on the −Z side, so as to be in one-to-one correspondence with the 2m cavities C. The driving signal VOUT and reference voltage signal VBS are supplied to each piezoelectric element 60. The piezoelectric element 60 is driven according to the difference in potential between the supplied driving signal VOUT and reference voltage signal VBS. When the piezoelectric element 60 is driven, the actuator substrate 336 is deformed. When the actuator substrate 336 is deformed, pressure in the relevant cavity C varies, discharging ink in the cavity C from the nozzle N through the flow path 333.

The structure including the cavity C, flow paths 331 and 333, nozzle N, actuator substrate 336, and piezoelectric element 60 is equivalent to the discharging section 600 described above. In the discharge head 300, a plurality of discharging sections 600 corresponding to a plurality of nozzles N are arranged in two rows in the Y direction, each row corresponding to one of the row La and row Lb.

The wiring board 338 illustrated in FIGS. 17 and 18 has a plane G1 and a plane G2 opposite to the plane G1. Two storage spaces 345 are formed in the plane G1, which is the surface of the wiring board 338 on the +Z side. One of the two storage spaces 345 stores m piezoelectric elements 60 corresponding to m nozzles Na. The other storage space 345 stores m piezoelectric elements 60 corresponding to m nozzles Nb. The width of this storage space 345 in the Z direction, that is, the height of the storage space 345, is large enough to prevent the piezoelectric element 60 and wiring board 338 from coming into contact with each other when the piezoelectric element 60 is driven.

The integrated circuit 362 is provided on the plane G2, opposite to the plane G1, of the wiring board 338. The driving signal selection circuit 200 described above is mounted in this integrated circuit 362. The print data signal SI, driving signals COMA and COMB, and other signals entered into the integrated circuit 362 and the driving signal VOUT output from the integrated circuit 362 propagate through lines (not illustrated) on the wiring board 338. One end of a coupling line 364 is electrically coupled to the wiring board 338. The other end of the coupling line 364 is coupled to the relevant wiring board 161, 162, 171, or 172.

The case 340 holds ink to be supplied to the 2m cavities C. The plane FB of the case 340, the plane being the surface of the discharge head 300 on the +Z side, is fixed to the plane FA of the flow path substrate 332 with an adhesive or the like. A recess 342, which is formed like a groove and extends in the X direction, is formed in the plane FB of the case 340. The wiring board 338 and integrated circuit 362 are stored in this recess 342. The coupling line 364 is disposed so as to pass through the inside of the recess 342.

The case 340 is formed by, for example, being injection-molded from a resin material. As illustrated in FIG. 18, a flow path RB communicating with the flow path RA is formed in the case 340. These flow path RA and flow path RB function as a reservoir Q that holds ink to be supplied to the 2m cavities C.

Two inlets 343 through which ink is supplied are formed in a plane F2, opposite to the plane FB, of the case 340 in correspondence with the rows La and Lb. Similarly, two outlets 344 from which ink held in the reservoir Q is ejected are formed in the plane F2 in correspondence with the rows La and Lb. The two inlets 343 through which ink is supplied communicate with the ink inlet Ii through an ink flow path formed in the flow path member 120 described above. The two outlets 344 from which ink is ejected communicate with the ink outlet Io through an ink flow path formed in the flow path member 120.

A heat dissipating member 363 is provided on the −Z side of the integrated circuit 362 and on the +Z side of the case 340. On the +Z side, the heat dissipating member 363 is coupled to the driving signal selection circuit 200 included in the integrated circuit 362. On the −Z side, the heat dissipating member 363 is coupled to the case 340. As described above, the integrated circuit 362 includes the driving signal selection circuit 200 that creates the driving signal VOUT from the driving signal COMA and/or driving signal COMB. The driving signal selection circuit 200 selects the waveforms of the driving signals COMA and COMB including a large current or leaves these waveforms unselected to create the driving signal VOUT. Therefore, a large current based on the driving signal COMA and/or driving signal COMB flows in the integrated circuit 362. This causes the integrated circuit 362 including the driving signal selection circuit 200 to generate a large amount of heat.

When the heat dissipating member 363 is coupled to the integrated circuit 362 of this type that generates a large amount of heat, it becomes possible for the heat dissipating member 363 to release heat generated at the integrated circuit 362. When the heat dissipating member 363 is coupled to the case 340 in which the flow path RB is provided, it becomes possible to heat ink flowing in the flow path RB. Thus, heat generated at the integrated circuit 362 including the driving signal selection circuit 200 can be transferred to the flow path RA through the heat dissipating member 363, making it possible to reduce thermal energy required to heat ink such as UV curable ink. As a result, the energy efficiency of the liquid discharging apparatus 1 can be further improved.

In coupling between the heat dissipating member 363 and the integrated circuit 362, the heat dissipating member 363 may be coupled to the integrated circuit 362 so that the heat dissipating member 363 is placed in direct contact with the integrated circuit 362. Alternatively, the heat dissipating member 363 may be coupled to the integrated circuit 362 through a cable such as an FFC and electric parts or through a fixing member such as an adhesive. That is, in coupling between the heat dissipating member 363 and the integrated circuit 362, the heat dissipating member 363 may be placed in contact with the integrated circuit 362, or may be coupled to the integrated circuit 362 through a cable and electric parts or through a fixing member such as an adhesive. In other words, coupling between the heat dissipating member 363 and the integrated circuit 362 includes thermal coupling between the heat dissipating member 363 and the integrated circuit 362 through solids or a liquid.

Similarly, in coupling between the heat dissipating member 363 and the case 340 having the flow path RB, the heat dissipating member 363 may be coupled to the case 340 having the flow path RB so that the case 340 is placed in direct contact with the heat dissipating member 363. Alternatively, the heat dissipating member 363 may be coupled to the case 340 having the flow path RB through a cable such as an FFC and electric parts or through a fixing member such as an adhesive. That is, in coupling between the heat dissipating member 363 and the case 340 having the flow path RB, the heat dissipating member 363 may be placed in contact with the case 340 having the flow path RB, or may be coupled to the case 340 having the flow path RB through a cable and electric parts or through a fixing member such as an adhesive. In other words, coupling between the heat dissipating member 363 and the case 340 having the flow path RB includes thermal coupling between the heat dissipating member 363 and the case 340 having the flow path RB through solids or a liquid.

In the case 340 including the flow path RB, ink discharged from the nozzle N flows. That is, the case 340 including the flow path RB is another example of the first flow path member.

As illustrated in FIG. 18, temperature adjusting sections 370 are provided at both ends of the discharge head 300 in the X direction, one at each end. The temperature adjusting section 370 includes the temperature measuring section 374, described above, that measures the temperature of ink discharged from the discharge head 300, and also includes the heat generating section 372, described above, that heats ink discharged from the nozzles N included in the discharge head 300 according to the result of temperature measurement by the temperature measuring section 374. As illustrated in FIG. 18, when, on the flow path RB through which ink is supplied from the inlets 343 toward the nozzle N, the temperature adjusting section 370 is positioned downstream of a coupled portion at which the heat dissipating member 363 and the case 340 including the flow path RB are coupled together, that is, on the same side as the nozzle N, the temperature of ink heated by the heat dissipating member 363 can be adjusted according to the result of temperature measurement by the temperature adjusting section 370. This can enhance the energy efficiency of the liquid discharging apparatus 1, and can further improve the discharge property of ink discharged from the discharge head 300.

1.5 Effects

With the liquid discharging apparatus 1 structured as described above in the first embodiment, ink flowing through the ink inlet Ii can be heated at it by transferring heat generated at the driving signal output circuit 50 included in the head unit 30 through the heat dissipating member 151 to the ink inlet Ii through which ink flows. Thus, in the liquid discharging apparatus 1 that discharges ink, such as UV curable ink, that is demanded to be heated, consumption of energy used to heat ink can be reduced. As a result, the energy efficiency of the liquid discharging apparatus 1 can be enhanced.

Furthermore, with the liquid discharging apparatus 1 in the first embodiment, ink flowing through the flow path RB can be heated at it by transferring heat generated at the driving signal selection circuit 200 included in the discharge head 300 in the head unit 30 through the heat dissipating member 363 to the case 340 having the flow path RB through which ink flows. Thus, in the liquid discharging apparatus 1 that discharges ink, such as UV curable ink, that is demanded to be heated, consumption of energy used to heat ink can be reduced. As a result, the energy efficiency of the liquid discharging apparatus 1 can be further enhanced.

1.6 Variation

In the above first embodiment, an ink jet printer that discharges UV curable ink has been described as an example of the liquid discharging apparatus 1. However, a liquid used in the liquid discharging apparatus 1 is not limited to UV curable ink. For example, a liquid used by the liquid discharging apparatus 1 may be an ink demanded to be heated according to the environment in which the liquid discharging apparatus 1 is used or an ink, other than a UV curable ink, that is heated to obtain more suitable ink's physical property.

2. Second Embodiment

The liquid discharging apparatus 1 in the first embodiment has been described by using an example in which the heat dissipating member 151 is formed from a single material having high thermal conductivity. However, the heat dissipating member 151 may be formed from two or more parts as illustrated in FIG. 19.

Figure 19:
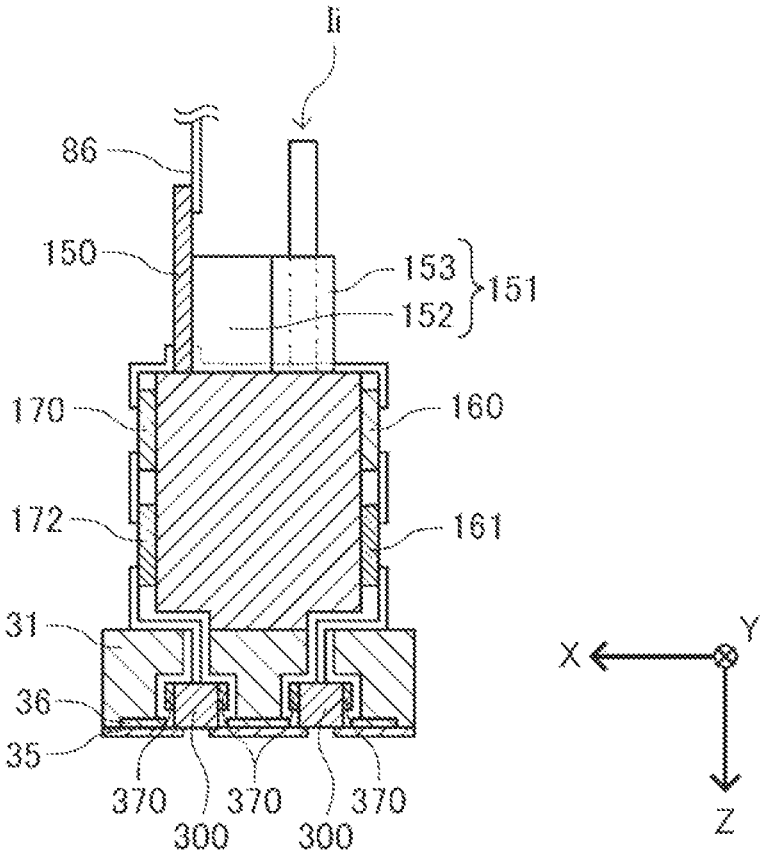
FIG. 19 is a sectional view of a head unit included in a liquid discharging apparatus in a second embodiment as taken along the X direction so as to pass through the ink inlet.

FIG. 19 is a sectional view of the head unit 30 included in the liquid discharging apparatus 1 in a second embodiment as taken along the X direction so that the head unit 30 is cut so as to pass through the ink inlet Ii. As illustrated in FIG. 19, the heat dissipating member 151 in the second embodiment includes a first heat dissipating part 152 coupled to the wiring board 150 as well as a second heat dissipating part 153 coupled to the ink inlet Ii.

Specifically, the heat dissipating member 151 includes the first heat dissipating part 152 and the second heat dissipating part 153 coupled to the first heat dissipating part 152; the first heat dissipating part 152 is coupled to the wiring board 150 on which the driving signal output circuit 50 is mounted, and the second heat dissipating part 153 is coupled to the ink inlet Ii.

The first heat dissipating part 152 and second heat dissipating part 153 can be formed from a material having high thermal conductivity. For example, they may be formed from a metal material such as aluminum, iron or copper or from a heat dissipation sheet made of a resin. Specifically, parts having different properties may be used as the first heat dissipating part 152 and second heat dissipating part 153 depending on the shape or material of the component to be coupled. Thus, the first heat dissipating part 152 can be coupled to the wiring board 150 and the driving signal output circuit 50 mounted on the wiring board 150 so as to follow the shapes of the wiring board 150 and various electronic parts included in the driving signal output circuit 50 mounted on the wiring board 150. Similarly, the second heat dissipating part 153 can be coupled to the ink inlet Ii so as to follow the shape of the ink inlet Ii. This can enhance tight adhesion between the heat dissipating member 151 and the wiring board 150 and the driving signal output circuit 50 mounted on the wiring board 150 and between the heat dissipating member 151 and the ink inlet Ii. At the ink inlet Ii, therefore, heat generated at the wiring board 150 on which the driving signal output circuit 50 is mounted can be more efficiently transferred to ink flowing through the ink inlet Ii.

That is, with the liquid discharging apparatus 1 in the second embodiment, since the heat dissipating member 151 includes the first heat dissipating part 152 and the second heat dissipating part 153 coupled to the first heat dissipating part 152, the first heat dissipating part 152 is coupled to the wiring board 150 on which the driving signal output circuit 50 is mounted, and the second heat dissipating part 153 is coupled to the ink inlet Ii, it becomes possible to select the first heat dissipating part 152 according to the material and shape of the wiring board 150 on which the driving signal output circuit 50 is mounted and to select the second heat dissipating part 153 according to the material and shape of the ink inlet Ii. As a result, in the liquid discharging apparatus 1 that discharges ink, such as UV curable ink, that is demanded to be heated, consumption of energy used to heat ink can be further reduced and the energy efficiency of the liquid discharging apparatus 1 can thereby be further enhanced.

So far, embodiments and a variation have been described. However, the present disclosure is not limited to the above embodiments and variation. The present disclosure can be practiced in various aspects without departing from the intended scope of the present disclosure. For example, the above embodiments and variation can be appropriately combined.

The present disclosure includes substantially the same structure as a structure described in the embodiments, the same structure being, for example, a structure in which a function, method, and result are the same or a structure having the same object and effects. The present disclosure also includes a structure in which a portion that is not essential to a structure described in the embodiments is replaced. The present disclosure also includes a structure that has the same effects as the effects of a structure described in the embodiments or a structure that can achieve the same object as the object of a structure described in the embodiments. The present disclosure also includes a structure in which a known technology is added to a structure described in the embodiments.

The following can be derived from the embodiments and variation described above.

A liquid discharging apparatus in one aspect has: a head unit that discharges a liquid; and a control unit that controls the operation of the head unit. The head unit has: a driving circuit board that includes a driving signal output circuit that outputs a driving signal, and also includes a substrate on which the driving signal output circuit is mounted; a discharge head that includes a driving element driven by the driving signal, a switching circuit that selectively supplies the driving signal to the driving element, and a nozzle plate in which a nozzle is formed, the nozzle discharging the liquid by being driven by the driving element; a first flow path member through which the liquid to be discharged from the nozzle passes; and a first heat dissipating member coupled to the driving circuit board. The first heat dissipating member is coupled to the first flow path member.

With this liquid discharging apparatus, it becomes possible to reduce heat generated at the driving signal output circuit by using the first heat dissipating member. It also becomes possible to use the heat generated at the driving signal output circuit to heat ink flowing in the first flow path member by transferring, through the first heat dissipating member, the heat generated at the driving signal output circuit to the first flow path member in which a liquid to be discharged from the nozzle flows. As a result, in the liquid discharging apparatus, consumption of energy used to heat ink flowing in the first flow path member can be reduced, and the energy efficiency of the liquid discharging apparatus can thereby be enhanced.

In the liquid discharging apparatus in the one aspect, the first heat dissipating member may include a first heat dissipating part and a second heat dissipating part coupled to the first heat dissipating part; the first heat dissipating part may be coupled to the driving circuit board; and the second heat dissipating part may be coupled to the first flow path member.

With this liquid discharging apparatus, the first heat dissipating member that transfers heat between the driving signal output circuit and the first flow path member is formed by a combination of a plurality of materials, so it becomes possible to select heat dissipating parts suitable for the shapes and materials of the driving signal output circuit and first flow path member. As a result, in the liquid discharging apparatus, consumption of energy used to heat ink flowing in the first flow path member can be further reduced, and the energy efficiency of the liquid discharging apparatus can thereby be further enhanced.

In the liquid discharging apparatus in the one aspect, the first heat dissipating member may be coupled to a line at a certain potential, the line being provided on the substrate.

With this liquid discharging apparatus, the line at a certain potential such as circuit ground occupies a wide area on the substrate, on which the driving signal output circuit is mounted. When the first heat dissipating member is coupled to this type of line occupying a wide area, the first heat dissipating member can further efficiently transfer heat generated at the driving signal output circuit. As a result, in the liquid discharging apparatus, consumption of energy used to heat ink flowing in the first flow path member can be further reduced, and the energy efficiency of the liquid discharging apparatus can thereby be further enhanced.

In the liquid discharging apparatus in the one aspect, the head unit may have a second heat dissipating member coupled to the switching circuit, and the second heat dissipating member may be coupled to the first flow path member.

With this liquid discharging apparatus, it becomes possible to use heat generated at the switching circuit to heat ink flowing in the first flow path member. In the liquid discharging apparatus, therefore, consumption of energy used to heat ink flowing in the first flow path member can be further reduced, and the energy efficiency of the liquid discharging apparatus can thereby be further enhanced.

In the liquid discharging apparatus in the one aspect, the head unit may have a temperature measuring section and a heat generating section; the temperature measuring section may detect the temperature of the liquid; and the heat generating section may heat the liquid according to the detection result of the temperature.

With this liquid discharging apparatus, it becomes possible to control the temperature of ink flowing in the first flow path member to more suitable temperature by using the temperature measuring section and heat generating section, improving the discharge property of a liquid.

In the liquid discharging apparatus in the one aspect, the temperature measuring section and heat generating section may be positioned downstream of a coupled portion between the first heat dissipating member and the first flow path member on an ink supply path through which the liquid is supplied from the first flow path member toward the nozzle.

With this liquid discharging apparatus, it becomes possible to control the temperature of ink flowing in the first flow path member to more suitable temperature by using the temperature measuring section and heat generating section, improving the discharge property of a liquid.

In the liquid discharging apparatus in the one aspect, the head unit may have a second flow path member through which the liquid is ejected from the discharge head; and the first heat dissipating member may be coupled to the second flow path member.

In the liquid discharging apparatus in the one aspect, it also becomes possible to heat ink to be ejected from the discharge head. As a result, the ink circulation efficiency in the liquid discharging apparatus can be enhanced, and the ink consumption efficiency in the liquid discharging apparatus can be improved.

A head unit in one aspect has: a driving circuit board that includes a driving signal output circuit that outputs a driving signal, and also includes a substrate on which the driving signal output circuit is mounted; a discharge head that includes a driving element driven by the driving signal, a switching circuit that selectively supplies the driving signal to the driving element, and a nozzle plate in which a nozzle is formed, the nozzle discharging a liquid by being driven by the driving element; a first flow path member through which the liquid to be discharged from the nozzle passes; and a first heat dissipating member coupled to the driving circuit board. The first heat dissipating member is coupled to the first flow path member.

With this head unit, it becomes possible to reduce heat generated at the driving signal output circuit by using the first heat dissipating member. It also becomes possible to use the heat generated at the driving signal output circuit to heat ink flowing in the first flow path member by transferring, through the first heat dissipating member, the heat generated at the driving signal output circuit to the first flow path member in which a liquid to be discharged from the nozzle flows. As a result, consumption of energy used to heat ink flowing in the first flow path member can be reduced, and the energy efficiency of the head unit can thereby be enhanced.

What is claimed is:

1. A liquid discharging apparatus comprising:

a head unit that discharges a liquid; and a control unit that controls an operation of the head unit; wherein the head unit has:

a driving circuit board that includes a driving signal output circuit that outputs a driving signal, and the driving circuit board as rectangular-shaped;

a discharge head housed by a holder, the discharge head includes:

a driving element driven by the driving signal;

a switching circuit that selectively supplies the driving signal to the driving element; and a nozzle plate in which a nozzle is formed, and the nozzle discharges the liquid by being driven by the driving element;

a first flow path member disposed on the holder, the liquid to be discharged from the nozzle passes through the first flow path member, and a liquid inlet pipe upwardly extends from a top of the first flow path member, and a first heat dissipating member disposed on the top of the first flow path member, and the first heat dissipating member is in a rectangular parallelepiped and has a side surface, the driving circuit board is disposed on the side surface of the first heat dissipating member, and an area of the driving: circuit board is larger than an area of the side surface of the first heat dissipating member.

2. The liquid discharging apparatus according to claim 1, wherein:

the first heat dissipating member includes a first heat dissipating part and a second heat dissipating part coupled to the first heat dissipating part;

the first heat dissipating part is coupled to the driving circuit board; and the second heat dissipating part is coupled to the first flow path member.

3. The liquid discharging apparatus according to claim 1, wherein the first heat dissipating member is coupled to a line at a certain potential, and the line is provided at the driving circuit board.

4. The liquid discharging apparatus according to claim 1, wherein:

the head unit has a second heat dissipating member coupled to the switching circuit; and the second heat dissipating member is coupled to the first flow path member.

5. The liquid discharging apparatus according to claim 1, wherein:

the head unit has a temperature measuring section and a heat generating section;

the temperature measuring section detects a temperature of the liquid; and the heat generating section heats the liquid according to a detection result of the temperature.

6. The liquid discharging apparatus according to claim 5, wherein the temperature measuring section and the heat generating section are positioned downstream of a coupled portion between the first heat dissipating member and the first flow path member on an ink supply path through which the liquid is supplied from the first flow path member toward the nozzle.

7. The liquid discharging apparatus according to claim 1, wherein:

the head unit has a second flow path member through which the liquid is ejected from the discharge head; and the first heat dissipating member is coupled to the second flow path member.

8. A head unit comprising:

a driving circuit board that includes a driving signal output circuit that outputs a driving signal, the driving circuit board being rectangular-shaped;

a discharge head housed by a holder, the discharge head including:

a driving element driven by the driving signal, a switching circuit that selectively supplies the driving signal to the driving element; and a nozzle plate in which a nozzle is formed, the nozzle discharging a liquid by being driven by the driving element;

a first flow path member disposed on the holder, the liquid to be discharged from the nozzle passing through the first flow path member, a liquid inlet pipe upwardly extending from a top of the first flow path member; and a first heat dissipating member disposed on the top of the first flow path member, the first heat dissipating member being in a rectangular parallelepiped and having a side surface, wherein the driving circuit board is disposed on the side surface of the first heat dissipating member, and an area of the driving circuit board is larger than an area of the side surface of the first heat dissipating member.

* * * * *